US007785443B2

(12) United States Patent
Hermans et al.

(10) Patent No.: US 7,785,443 B2
(45) Date of Patent: Aug. 31, 2010

(54) PROCESS FOR PRODUCING TISSUE PRODUCTS

(75) Inventors: Michael Alan Hermans, Neenah, WI (US); Michael J. Rekoske, Appleton, WI (US); Thomas Joseph Dyer, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 639 days.

(21) Appl. No.: 11/635,379

(22) Filed: Dec. 7, 2006

(65) Prior Publication Data

US 2008/0135195 A1 Jun. 12, 2008

(51) Int. Cl.
*D21H 23/22* (2006.01)
*D21H 23/56* (2006.01)
*D21F 11/00* (2006.01)

(52) U.S. Cl. ..... 162/168.1; 162/111; 162/158; 162/164.1; 162/184; 162/204; 162/136

(58) Field of Classification Search ..... 162/111, 162/136, 158, 164.1, 168, 1, 184, 204
See application file for complete search history.

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,538 | A | 3/1970 | Petersen |
| 3,502,763 | A | 3/1970 | Hartmann |
| 3,542,615 | A | 11/1970 | Dobo et al. |
| 3,556,932 | A | 1/1971 | Coscia et al. |
| 3,556,933 | A | 1/1971 | Williams et al. |
| 3,575,173 | A | 4/1971 | Loyer |
| 3,585,104 | A | 6/1971 | Kleinert |
| 3,645,992 | A | 2/1972 | Elston |
| 3,669,822 | A | 6/1972 | Cowen |

(Continued)

FOREIGN PATENT DOCUMENTS

| | | |
|---|---|---|
| CA | 2273912 | 7/1998 |

(Continued)

OTHER PUBLICATIONS

ASTM Designation: D 1238—04c entitled Standard Test Method for Melt Flow Rates of Thermoplastics by Extrusion Plastometer, Dec. 1, 2004, pp. 1-14.

(Continued)

*Primary Examiner*—Eric Hug
*Assistant Examiner*—Dennis Cordray
(74) *Attorney, Agent, or Firm*—Dority & Manning, P.A.

(57) ABSTRACT

Tissue products are disclosed containing an additive composition. The additive composition, for instance, comprises an aqueous dispersion containing an alpha-olefin polymer, an ethylene-carboxylic acid copolymer, or mixtures thereof. The alpha-olefin polymer may comprise an interpolymer of ethylene and octene, while the ethylene-carboxylic acid copolymer may comprise ethylene-acrylic acid copolymer. The additive composition may also contain a dispersing agent, such as a fatty acid. The additive composition may be incorporated into the tissue web as the web is being formed. Alternatively, the additive composition may be topically applied to the web in a post processing operation. For instance, in one embodiment, the additive composition may be applied to the web as a creping adhesive during a creping operation.

24 Claims, 11 Drawing Sheets

U.S. PATENT DOCUMENTS

| | | | |
|---|---|---|---|
| 3,692,618 | A | 9/1972 | Dorschner et al. |
| 3,700,623 | A | 10/1972 | Keim |
| 3,772,076 | A | 11/1973 | Keim |
| 3,802,817 | A | 4/1974 | Matsuki et al. |
| 3,849,241 | A | 11/1974 | Butin et al. |
| 3,855,158 | A | 12/1974 | Petrovich et al. |
| 3,879,257 | A | 4/1975 | Gentile et al. |
| 3,899,388 | A | 8/1975 | Petrovich et al. |
| 4,076,698 | A | 2/1978 | Anderson et al. |
| 4,100,324 | A | 7/1978 | Anderson et al. |
| 4,129,528 | A | 12/1978 | Petrovich et al. |
| 4,147,586 | A | 4/1979 | Petrovich et al. |
| 4,222,921 | A | 9/1980 | Van Eenam |
| 4,309,510 | A | 1/1982 | Kleber |
| 4,326,000 | A | 4/1982 | Roberts, Jr. |
| 4,340,563 | A | 7/1982 | Appel et al. |
| 4,355,066 | A | 10/1982 | Newman |
| 4,375,448 | A | 3/1983 | Appel et al. |
| 4,440,898 | A | 4/1984 | Pomplun et al. |
| 4,494,278 | A | 1/1985 | Kroyer et al. |
| 4,514,345 | A | 4/1985 | Johnson et al. |
| 4,528,239 | A | 7/1985 | Trokhan |
| 4,574,021 | A | 3/1986 | Endres et al. |
| 4,594,130 | A | 6/1986 | Chang et al. |
| 4,599,392 | A | 7/1986 | McKinney et al. |
| 4,640,810 | A | 2/1987 | Laursen et al. |
| 4,793,898 | A | 12/1988 | Laamanen et al. |
| 4,818,464 | A | 4/1989 | Lau |
| 4,837,070 | A | 6/1989 | Weber et al. |
| 4,950,545 | A | 8/1990 | Walter et al. |
| 4,975,320 | A | 12/1990 | Goldstein et al. |
| 4,988,781 | A | 1/1991 | McKinney et al. |
| 5,008,344 | A | 4/1991 | Bjorkquist |
| 5,085,736 | A | 2/1992 | Bjorkquist |
| 5,098,522 | A | 3/1992 | Smurkoski et al. |
| 5,104,923 | A | 4/1992 | Steinwand et al. |
| 5,109,063 | A | 4/1992 | Cheng et al. |
| 5,129,988 | A | 7/1992 | Farrington, Jr. |
| 5,160,484 | A | 11/1992 | Nikoloff |
| 5,227,242 | A | 7/1993 | Walter et al. |
| 5,260,171 | A | 11/1993 | Smurkoski et al. |
| 5,272,236 | A | 12/1993 | Lai et al. |
| 5,275,700 | A | 1/1994 | Trokhan |
| 5,278,272 | A | 1/1994 | Lai et al. |
| 5,328,565 | A | 7/1994 | Rasch et al. |
| 5,334,289 | A | 8/1994 | Trokhan et al. |
| 5,382,400 | A | 1/1995 | Pike et al. |
| 5,384,373 | A | 1/1995 | McKinney et al. |
| 5,385,643 | A | 1/1995 | Ampulski |
| 5,389,202 | A | 2/1995 | Everhart et al. |
| 5,389,204 | A | 2/1995 | Ampulski |
| 5,429,686 | A | 7/1995 | Chiu et al. |
| 5,431,786 | A | 7/1995 | Rasch et al. |
| 5,432,000 | A | 7/1995 | Young et al. |
| 5,496,624 | A | 3/1996 | Stelljes, Jr. et al. |
| 5,500,277 | A | 3/1996 | Trokhan et al. |
| 5,514,523 | A | 5/1996 | Trokhan et al. |
| 5,518,585 | A | 5/1996 | Huth et al. |
| 5,527,171 | A | 6/1996 | Soerensen |
| 5,529,665 | A | 6/1996 | Kaun |
| 5,543,215 | A | 8/1996 | Hansen et al. |
| 5,554,467 | A | 9/1996 | Trokhan et al. |
| 5,558,873 | A | 9/1996 | Funk et al. |
| 5,566,724 | A | 10/1996 | Trokhan et al. |
| 5,573,637 | A | 11/1996 | Ampulski et al. |
| 5,595,628 | A | 1/1997 | Gordon et al. |
| 5,624,790 | A | 4/1997 | Trokhan et al. |
| 5,628,876 | A | 5/1997 | Ayers et al. |
| 5,656,132 | A | 8/1997 | Farrington, Jr. et al. |
| 5,672,248 | A | 9/1997 | Wendt et al. |
| 5,677,383 | A | 10/1997 | Chum et al. |
| 5,830,320 | A | 11/1998 | Park et al. |
| 5,844,045 | A | 12/1998 | Kolthammer et al. |
| 5,869,575 | A | 2/1999 | Kolthammer et al. |
| 5,871,763 | A | 2/1999 | Luu et al. |
| 5,885,697 | A | 3/1999 | Krzysik et al. |
| 5,935,384 | A | 8/1999 | Taniguchi |
| 6,033,761 | A | 3/2000 | Dwiggins et al. |
| 6,054,020 | A | 4/2000 | Goulet et al. |
| 6,096,152 | A | 8/2000 | Anderson et al. |
| 6,096,169 | A | 8/2000 | Hermans et al. |
| 6,111,023 | A | 8/2000 | Chum et al. |
| 6,120,642 | A | 9/2000 | Lindsay et al. |
| 6,129,815 | A | 10/2000 | Larson et al. |
| 6,143,135 | A | 11/2000 | Hada et al. |
| 6,171,441 | B1 | 1/2001 | Phillips et al. |
| 6,194,517 | B1 | 2/2001 | Pomplun et al. |
| 6,197,154 | B1 | 3/2001 | Chen et al. |
| 6,224,714 | B1 | 5/2001 | Schroeder et al. |
| 6,231,719 | B1 | 5/2001 | Garvey et al. |
| 6,274,667 | B1 | 8/2001 | Shannon et al. |
| 6,287,418 | B1 | 9/2001 | Schroeder et al. |
| 6,291,372 | B1 | 9/2001 | Mumick et al. |
| 6,316,549 | B1 | 11/2001 | Brand et al. |
| 6,361,784 | B1 | 3/2002 | Brennan et al. |
| 6,365,667 | B1 | 4/2002 | Shannon et al. |
| 6,379,498 | B1 | 4/2002 | Burns et al. |
| 6,423,270 | B1 | 7/2002 | Wall |
| 6,447,643 | B2 | 9/2002 | Fingal et al. |
| 6,448,341 | B1 | 9/2002 | Kolthammer et al. |
| 6,538,070 | B1 | 3/2003 | Cardwell et al. |
| 6,566,446 | B1 | 5/2003 | Parikh et al. |
| 6,570,054 | B1 | 5/2003 | Gatto et al. |
| 6,617,490 | B1 | 9/2003 | Chen et al. |
| 6,716,203 | B2 | 4/2004 | Sorebo et al. |
| 6,764,988 | B2 | 7/2004 | Koenig et al. |
| 6,908,966 | B2 | 6/2005 | Chang et al. |
| 6,911,573 | B2 | 6/2005 | Chen et al. |
| 6,913,673 | B2 | 7/2005 | Baggot et al. |
| 6,951,598 | B2 | 10/2005 | Flugge et al. |
| 6,991,706 | B2 | 1/2006 | Lindsay et al. |
| 6,994,865 | B2 | 2/2006 | Branham et al. |
| 2002/0103469 | A1 | 8/2002 | Chen |
| 2002/0115744 | A1 | 8/2002 | Svenningsen et al. |
| 2002/0162243 | A1 | 11/2002 | Runge et al. |
| 2003/0027470 | A1 | 2/2003 | Chang et al. |
| 2003/0072950 | A1 | 4/2003 | Rodrigues et al. |
| 2003/0121627 | A1 | 7/2003 | Hu et al. |
| 2004/0020114 | A1 | 2/2004 | Boehmer et al. |
| 2004/0084165 | A1 | 5/2004 | Shannon et al. |
| 2004/0099388 | A1 | 5/2004 | Chen et al. |
| 2004/0099389 | A1 | 5/2004 | Chen et al. |
| 2004/0118532 | A1 | 6/2004 | Sarbo et al. |
| 2004/0118540 | A1 | 6/2004 | Garnier et al. |
| 2004/0191486 | A1 | 9/2004 | Underhill et al. |
| 2004/0209539 | A1 | 10/2004 | Confalone et al. |
| 2004/0234804 | A1 | 11/2004 | Liu et al. |
| 2005/0010075 | A1 | 1/2005 | Powers |
| 2005/0045292 | A1* | 3/2005 | Lindsay et al. ..... 162/109 |
| 2005/0045294 | A1 | 3/2005 | Goulet et al. |
| 2005/0045295 | A1 | 3/2005 | Goulet et al. |
| 2005/0058693 | A1 | 3/2005 | Joseph et al. |
| 2005/0058833 | A1 | 3/2005 | Krzysik et al. |
| 2005/0100754 | A1 | 5/2005 | Moncla et al. |
| 2005/0118435 | A1 | 6/2005 | Delucia et al. |
| 2005/0124753 | A1 | 6/2005 | Ashihara et al. |
| 2005/0136766 | A1 | 6/2005 | Tanner et al. |
| 2005/0148257 | A1 | 7/2005 | Hermans et al. |
| 2005/0192365 | A1 | 9/2005 | Strandburg et al. |
| 2005/0214335 | A1 | 9/2005 | Allen et al. |
| 2005/0217814 | A1* | 10/2005 | Super et al. ..... 162/111 |
| 2005/0224200 | A1 | 10/2005 | Bouchard et al. |
| 2005/0241789 | A1 | 11/2005 | Reddy |
| 2006/0014884 | A1 | 1/2006 | Goulet et al. |

| | | | |
|---|---|---|---|
| 2006/0070712 | A1 | 4/2006 | Runge et al. |
| 2006/0085998 | A1 | 4/2006 | Herman et al. |
| 2006/0086472 | A1 | 4/2006 | Herman et al. |
| 2007/0020315 | A1 | 1/2007 | Shannon et al. |
| 2007/0137808 | A1 | 6/2007 | Lostocco et al. |
| 2007/0137809 | A1 | 6/2007 | Dyer et al. |
| 2007/0137810 | A1 | 6/2007 | Dyer et al. |
| 2007/0137811 | A1 | 6/2007 | Runge et al. |
| 2007/0137813 | A1 | 6/2007 | Nickel et al. |
| 2007/0141936 | A1 | 6/2007 | Bunyard et al. |
| 2007/0144697 | A1 | 6/2007 | Dyer et al. |
| 2007/0295464 | A1 | 12/2007 | Fetner et al. |
| 2008/0000598 | A1 | 1/2008 | Dyer et al. |
| 2008/0000602 | A1 | 1/2008 | Dyer et al. |
| 2008/0041543 | A1 | 2/2008 | Dyer et al. |
| 2008/0073045 | A1 | 3/2008 | Dyer et al. |
| 2008/0073046 | A1 | 3/2008 | Dyer et al. |
| 2008/0135195 | A1 | 6/2008 | Hermans et al. |

FOREIGN PATENT DOCUMENTS

| | | | |
|---|---|---|---|
| DE | 41 42 460 | A1 | 6/1993 |
| EP | 0608460 | A1 | 1/1993 |
| EP | 0620256 | A2 | 3/1994 |
| EP | 0857453 | A1 | 2/1997 |
| EP | 0 926288 | B1 | 6/1999 |
| EP | 1344511 | A2 | 7/2003 |
| GB | 142441 | | 3/1921 |
| GB | 2246373 | A | 1/1992 |
| WO | WO 9501479 | A1 | 1/1995 |
| WO | WO 97/33921 | | 9/1997 |
| WO | WO 9934057 | A1 | 7/1999 |
| WO | WO 0066835 | A1 | 11/2000 |
| WO | WO 0147699 | | 7/2001 |
| WO | WO 0149933 | | 7/2001 |
| WO | WO 0248458 | A1 | 6/2002 |
| WO | WO 03040442 | A1 | 5/2003 |
| WO | WO 2005021622 | A2 | 3/2005 |
| WO | WO 2005021638 | A2 | 3/2005 |
| WO | WO 2005031068 | A1 | 4/2005 |
| WO | WO 2005080677 | A2 | 9/2005 |
| WO | WO 2006/038977 | | 4/2006 |
| WO | WO 2007/070114 | | 6/2007 |
| WO | WO 2007/070145 | | 6/2007 |
| WO | WO 2007070129 | A1 | 6/2007 |
| WO | WO 2007070145 | A1 | 6/2007 |
| WO | WO 2007070153 | A1 | 6/2007 |
| WO | WO 2007075356 | A1 | 7/2007 |
| WO | WO 2007078342 | A1 | 7/2007 |
| WO | WO 2007078499 | A1 | 7/2007 |
| WO | WO 2008/068651 | A2 * | 12/2008 |

OTHER PUBLICATIONS

ASTM Designation: D 79—98 entitled Standard Test Method for Density and Specific Gravity (Relative Density) of Plastics by Displacement, Aug. 10, 1998, pp. 159-163.

Material Safety Data Sheet from DuPont Dow Elastomers L. L. C., for "ENGAGE", Mar. 29, 1999, 7 pages.

Paper entitled "Polymer Nanocomposite" by Chou et al. of The Dow Chemical Company, 2002, 5 pages.

Product Information for Affinity EG 8200 (Polyolefin Plastomer for General Plastomeric Applications) from The Dow Chemical Company, May 2001, 2 pages.

TAPPI—T 411 om-89 entitled "Thickness (caliper) of paper, paperboard, and combined board", Jun. 15, 1989, 3 pages.

Search Report for Int'l Appl. No. PCT/US2006/037844 mailed Feb. 1, 2007.

Search Report and Written Opinion for PCT/US2006/033227, Jun. 5, 2007.

Search Report and Written Opinion for PCT/US2006/047785, Oct. 5, 2007.

Search Report and Written Opinion for PCT/US2006/038991, Feb. 9, 2007.

Search Report and Written Opinion for PCT/US2006/033224, Dec. 27, 2006.

Search Report and Written Opinion for PCT/IB2007/054405, completed Feb. 28, 2008.

U.S. Appl. No. 11/635,379, filed Dec. 7, 2006 entitled "Process for Producing Tissue Products".

Search Report and Written Opinion for PCT/IB2007/046062 dated May 3, 2007.

Search Report and Written Opinion for PCT/IB2007/054404 dated May 21, 2008.

Search Report and Written Opinion for PCT/IB2007/054651 dated Aug. 4, 2008.

Search Report and Written Opinion for PCT/IB2007/054652 dated Aug. 4, 2008.

Search Report and Written Opinion for PCT/IB2007/054367 dated Aug. 4, 2008.

* cited by examiner

PROCESS FOR PRODUCING TISSUE PRODUCTS

BACKGROUND

Absorbent tissue products such as paper towels, facial tissues, bath tissues and other similar products are designed to include several important properties. For example, the products should have good bulk, a soft feel and should be highly absorbent. The product should also have good strength and resist tearing, even while wet. Unfortunately, it is very difficult to produce a high strength tissue product that is also soft and highly absorbent. Usually, when steps are taken to increase one property of the product, other characteristics of the product are adversely affected.

For instance, softness is typically increased by decreasing or reducing cellulosic fiber bonding within the tissue product. Inhibiting or reducing fiber bonding, however, adversely affects the strength of the tissue web.

In other embodiments, softness is enhanced by the topical addition of a softening agent to the outer surfaces of the tissue web. The softening agent may comprise, for instance, a silicone. The silicone may be applied to the web by printing, coating or spraying. Although silicones make the tissue webs feel softer, silicones can be relatively expensive and may lower sheet durability as measured by tensile strength and/or tensile energy absorbed.

In order to improve durability, in the past, various strength agents have been added to tissue products. The strength agents may be added to increase the dry strength of the tissue web or the wet strength of the tissue web. Some strength agents are considered temporary, since they only maintain wet strength in the tissue for a specific length of time. Temporary wet strength agents, for instance, may add strength to bath tissues during use while not preventing the bath tissues from disintegrating when dropped in a commode and flushed into a sewer line or septic tank.

Bonding agents have also been topically applied to tissue products alone or in combination with creping operations. For example, one particular process that has proved to be very successful in producing paper towels and wipers is disclosed in U.S. Pat. No. 3,879,257 to Gentile. et al., which is incorporated herein by reference in its entirety. In Gentile, et al., a process is disclosed in which a bonding material is applied in a fine, defined pattern to one side of a fibrous web. The web is then adhered to a heated creping surface and creped from the surface. A bonding material is applied to the opposite side of the web and the web is similarly creped. The process disclosed in Gentile, et al. produces wiper products having exceptional bulk, outstanding softness and good absorbency. The surface regions of the web also provide excellent strength, abrasion resistance, and wipe-dry properties.

Although the process and products disclosed in Gentile. et al. have provided many advances in the art of making paper wiping products, further improvements in various aspects of paper wiping products remain desired. For example, particular strength agents are still needed that can be incorporated into tissue webs without significantly adversely impacting the softness of the webs. A need also exists for a strength agent that can be incorporated into the web at any point during its production. For instance, a need exists for a strength agent that can be added to a pulpsheet prior to slurry formation, an aqueous suspension of fibers used to form a tissue web, a formed tissue web prior to drying, and/or to a tissue web that has been dried.

Furthermore, in the past, additive compositions topically applied to tissue webs had a tendency, under some circumstances, to create blocking problems, which refers to the tendency of two adjacent tissue sheets to stick together. As such, a need also exists for an additive composition or strength agent that is topically applied to a tissue web without creating blocking problems.

SUMMARY

In general, the present disclosure is directed to wet and dry tissue products having improved properties due to the presence of an additive composition. The tissue product may comprise, for instance, a bath tissue, a facial tissue, a paper towel, an industrial wiper, and the like. The tissue product may contain one ply or may contain multiple plies. The additive composition can be incorporated into the tissue product in order to improve the strength of the product without significantly affecting the softness and/or blocking behavior of the product in a negative manner. In fact, the softness can actually be increased. The additive composition can also increase strength without associated problems with blocking. The additive composition may comprise, for instance, an aqueous dispersion containing a thermoplastic resin. In one embodiment, the additive composition is applied topically to the tissue web such as during a creping operation.

The additive composition may comprise a non-fibrous olefin polymer. The additive composition, for instance, may comprise a film-forming composition and the olefin polymer may comprise an interpolymer of ethylene and at least one comonomer comprising an alkene, such as 1-octene. The additive composition may also contain a dispersing agent, such as a carboxylic acid. Examples of particular dispersing agents, for instance, include fatty acids, such as oleic acid or stearic acid.

In one particular embodiment, the additive composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50%, such as less than about 20%. The olefin polymer may also have a melt index of less than about 1000 g/10 min, such as less than about 700 g/10 min. The olefin polymer may also have a relatively small particle size, such as from about 0.1 micron to about 5 microns when contained in an aqueous dispersion.

In an alternative embodiment, the additive composition may contain an ethylene-acrylic acid copolymer. The ethylene-acrylic acid copolymer may be present in the additive composition in combination with a dispersing agent, such as a fatty acid.

In one embodiment, the additive composition can be topically applied to one or both sides of a tissue web. Once applied to a tissue web, it has been discovered that the additive composition forms a discontinuous film. For instance, depending upon the amount of additive composition applied to the web, the additive composition can form an interconnected film. At lower amounts, the additive composition can form small film-like islands or discrete areas covering the web. In either case, the additive composition can increase the strength of the web without significantly interfering with the ability of the web to absorb fluids. For example, the discontinuous film that is formed includes openings that allow liquids to be absorbed by the tissue web.

Also of advantage, the additive composition does not substantially penetrate into the tissue web when applied. For instance, the additive composition penetrates the tissue web in an amount less than about 30% of the thickness of the web, such as less than about 20%, such as less than about 10% of the thickness of the web. By remaining primarily on the surface of the web, the additive composition does not interfere with the liquid absorption capacity properties of the web. Further, the additive composition forms a discontinuous film on the web without substantially increasing the stiffness of the web and, as described above, without creating problems with blocking.

In one embodiment, the additive composition can be applied to a tissue web during formation of the web. In general, the treated tissue web can be made according to any conventional tissue making process. For instance, in one particular embodiment, a tissue product made according to the present disclosure can be formed by a process that includes the steps of first forming a tissue web from an aqueous suspension of fibers. The wet tissue web is then conveyed through a first through-air dryer and through a second through-air dryer that are arranged in series. The first and second through-air dryers substantially dry the tissue web. In accordance with the present disclosure, the additive composition can be applied to the tissue web at virtually any point in the process. For instance, in one embodiment, the additive composition can be applied between the first through-air dryer and the second through-air dryer while the tissue web is at a consistency of at least about 40%, such as from about 40% to about 60%. Alternatively, the additive composition can be applied to the web after the web exits the second through-air dryer when the web is substantially dried.

In another embodiment, the tissue making process can include a de-watering device that de-waters the tissue web prior to conveying the tissue web through one or more drying devices. In this embodiment, the additive composition can be applied to the tissue web after the de-watering device and/or at one or more drying devices or between two adjacent drying devices.

The de-watering device may have various configurations. For instance, in one embodiment, the de-watering device may comprise a vacuum device such as a vacuum box or a vacuum roll. The wet tissue web, for instance, may be passed over the vacuum device while being conveyed in between a permeable structured fabric and a permeable de-watering fabric, the de-watering fabric being adjacent to the vacuum device. A suction force can then be applied against the permeable structured fabric while the tissue web passes over the vacuum device for de-watering the tissue web.

In another embodiment, in order to de-water the tissue web, the tissue web is conveyed through a nip formed between an imprinting conveyor and a first de-watering felt. The de-watering felt may be pressed against the tissue web through the use of a shoe press including a backing member. A second de-watering felt may be used to apply pressure against the imprinting conveyor. In this embodiment, once fed through the compression nip, the tissue web may be deflected causing the imprinting member to form a molded web.

In still another embodiment, the de-watering device may comprise a nip formed between a moving transfer surface and a creping fabric. In this embodiment, the creping fabric may be traveling at a slower speed than the transfer surface. In this manner, the tissue web is creped from the transfer surface as the web is transferred to the creping fabric. The transfer surface may comprise, for instance, a rotating drum or cylinder that can be heated. When heated, the additive composition can be applied to the transfer surface for application to the tissue web.

The drying devices as used in the above tissue making processes may comprise heated cylinders including Yankee dryers, through-air dryers, and the like. Depending upon the particular application, once the additive composition is applied to the web, the web can be heated to a temperature in the range of equal to or greater than the melting point temperature of the base polymer in the additive composition. When a heated cylinder is used as a drying device, the additive composition can be applied directly to the web and then adhered to the surface of the dryer or may be indirectly applied to the web by being first applied to the dryer surface.

In one particular embodiment, the tissue making process may include one or more through-air dryers followed by a heated cylinder. In this embodiment, the additive composition can be applied after the through-air dryer and prior to the heated cylinder and/or may be applied to the heated cylinder.

In an alternative embodiment, the additive composition may be applied to the tissue web after the web has been formed and dried. For instance, in this embodiment, the additive composition may be applied to the tissue for adhering the tissue web to a creping drum and for creping the tissue web from the drum surface.

In this embodiment, for instance, the additive composition may be applied to one side of the tissue web according to a pattern. The pattern may comprise, for instance, a pattern of discrete shapes, a reticulated pattern, or a combination of both. In order to apply the additive composition to the tissue web, the additive composition may be printed onto the tissue web according to the pattern. For instance, in one embodiment, a rotogravure printer may be used.

The additive composition may be applied to one side of the tissue web in an amount from about 0.1% to about 30% by weight. Once applied, the additive composition stays substantially on the surface of the tissue web for increasing strength without interfering with the absorption properties of the web. For instance, when applied to the tissue web, the additive composition may penetrate the tissue web less than about 10% of the thickness of the tissue web, such as less than about 5% of the thickness of the web. The additive composition may form a discontinuous film on the surface of the tissue web for providing strength while also providing untreated areas where liquids may be quickly absorbed by the web.

When the tissue web is adhered to the creping drum, if desired, the creping drum may be heated. For instance, the creping surface may be heated to a temperature of from about 80° C. to about 200° C., such as from about 100° C. to about 150° C. The additive composition may be applied only to a single side of the tissue web or may be applied to both sides of the web according to the same or different patterns. When applied to both sides of the web, both sides of the web may be creped from a creping drum or only one side of the web may be creped.

The tissue web treated with the additive composition may, in one embodiment, comprise an uncreped through-air dried web prior to applying the additive composition. Once creped from the creping surface, the web may have a relatively high bulk, such as greater than about 10 cc/g. The tissue product may be used as a single ply product or may be incorporated into a multiple ply product.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
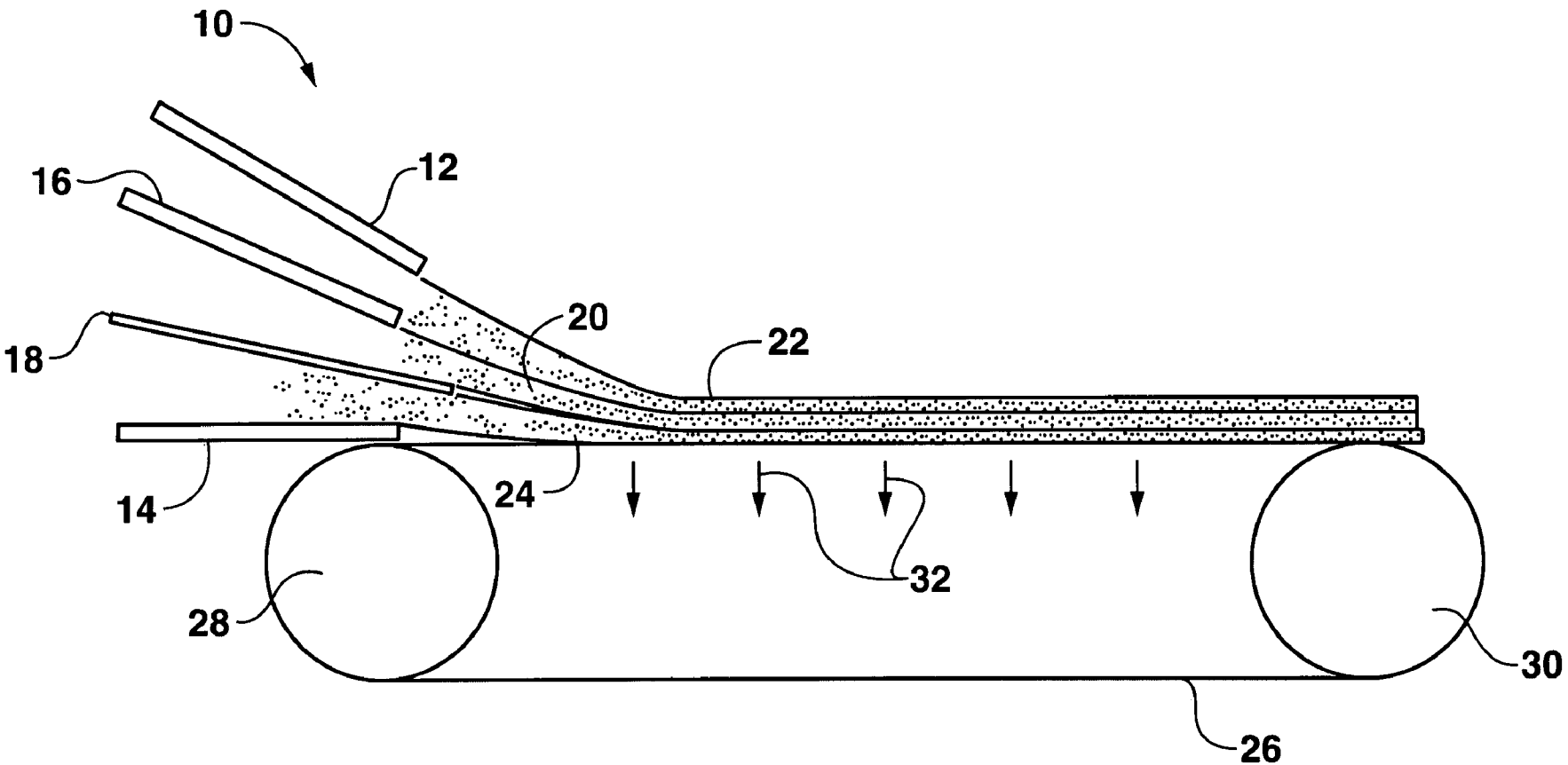
FIG. 1 is a schematic diagram of a tissue web forming machine, illustrating the formation of a stratified tissue web having multiple layers in accordance with the present disclosure.

Repeat use of reference characters in the present specification and drawings is intended to represent same or analogous features or elements of the present disclosure.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to the incorporation of an additive composition into a tissue web in order to improve the strength of the web. The strength of the web can be increased without significantly adversely affecting the perceived softness properties of the web. In fact, the softness can actually be increased during the process. The additive composition may comprise a polyolefin dispersion. For example, the polyolefin dispersion may contain polymeric particles having a relatively small size, such as less than about 5 microns, in an aqueous medium when applied or incorporated into a tissue web. Once dried, however, the polymeric particles are generally indistinguishable. For example, in one embodiment, the additive composition may comprise a film-forming composition that forms a discontinuous film. In some embodiments, the polyolefin dispersion may also contain a dispersing agent.

As will be described in greater detail below, the additive composition can be incorporated into a tissue web using various techniques and during different stages of production of the tissue product. For example, in one embodiment, the additive composition may be topically applied to the tissue web while the tissue web is wet or after the tissue web has been dried. For instance, in one embodiment, the additive composition may be applied topically to the tissue web. For example, the additive composition may be applied to a tissue web during a creping operation. In particular, the additive composition has been found well-suited for adhering a tissue web to a creping surface during a creping process.

The use of the additive composition containing a polyolefin dispersion has been found to provide various benefits and advantages depending upon the particular embodiment. For example, the additive composition has been found to improve the geometric mean tensile strength and the geometric mean tensile energy absorbed of treated tissue webs in comparison to untreated webs. Further, the above strength properties may be improved without significantly adversely impacting the stiffness of the tissue webs in relation to untreated webs and in relation to tissue webs treated with a silicone composition, as has been commonly done in the past. Thus, tissue webs made according to the present disclosure may have a perceived softness that is similar to or equivalent with tissue webs treated with a silicone composition. Tissue webs made according to the present disclosure, however, may have significantly improved strength properties at the same perceived softness levels.

The increase in strength properties is also comparable to prior art tissue webs treated with a bonding material, such as an ethylene-vinyl acetate copolymer. Problems with sheet blocking, however, which is the tendency of adjacent sheets to stick together, is significantly reduced when tissue webs are made in accordance with the present disclosure as compared to those treated with an ethylene-vinyl acetate copolymer additive composition, as has been done in the past.

The above advantages and benefits may be obtained by incorporating the additive composition into the tissue web at virtually any point during the manufacture of the web. The additive composition generally contains an aqueous dispersion comprising at least one thermoplastic resin, water, and, optionally, at least one dispersing agent. The thermoplastic resin is present within the dispersion at a relatively small particle size. For example, the average volumetric particle size of the polymer may be less than about 5 microns. The actual particle size may depend upon various factors including the thermoplastic polymer that is present in the dispersion. Thus, the average volumetric particle size may be from about 0.05 microns to about 5 microns, such as less than about 4 microns, such as less than about 3 microns, such as less than about 2 microns, such as less than about 1 micron. Particle sizes can be measured on a Coulter LS230 light-scattering particle size analyzer or other suitable device. When present in the aqueous dispersion and when present in the tissue web, the thermoplastic resin is typically found in a non-fibrous form.

The particle size distribution of the polymer particles in the dispersion may be less than or equal to about 2.0 microns, such as less than 1.9, 1.7 or 1.5 microns.

Examples of aqueous dispersions that may be incorporated into the additive composition of the present disclosure are disclosed, for instance, in U.S. Patent Application Publication No. 2005/0100754, U.S. Patent Application Publication No. 2005/0192365, PCT Publication No. WO 2005/021638, and PCT Publication No. WO 2005/021622, which are all incorporated herein by reference.

In one embodiment, the additive composition may comprise a film forming composition capable of forming a film on the surface of a tissue web. For instance, when topically applied to a tissue web, the additive composition can form a discontinuous film. For instance, when applied in relatively small amounts, the additive composition can form discrete film-like areas on the surface of the web. In greater amounts, however, the additive composition can form an interconnected film. In other words, the additive composition can form an interconnected polymer network over the surface of the tissue web. The film or polymer network, however, is discontinuous in that various openings are contained within the film. The size of the openings can vary depending upon the amount of additive composition that is applied to the web and the manner in which the additive composition is applied. Of particular advantage, the openings allow liquids to be absorbed through the discontinuous film and into the interior of the tissue web. In this regard, the wicking properties of the tissue web are not substantially affected by the presence of the additive composition.

Further, in some embodiments, the additive composition remains primarily on the surface of the tissue web and does not penetrate the web once applied. In this manner, not only does the discontinuous film allow the tissue web to absorb fluids that contact the surface but also does not significantly interfere with the ability of the tissue web to absorb relatively large amounts of fluid. Thus, the additive composition does not significantly interfere with the liquid absorption properties of the web while increasing the strength of the web without substantially impacting adversely on the stiffness of the web.

The thermoplastic resin contained within the additive composition may vary depending upon the particular application and the desired result. In one embodiment, for instance, thermoplastic resin is an olefin polymer. As used herein, an olefin polymer refers to a class of unsaturated open-chain hydrocarbons having the general formula $C_nH_{2n}$. The olefin polymer may be present as a copolymer, such as an interpolymer. As used herein, a substantially olefin polymer refers to a polymer that contains less than about 1% substitution.

In one particular embodiment, for instance, the olefin polymer may comprise an alpha-olefin interpolymer of ethylene with at least one comonomer selected from the group consisting of a $C_4$-$C_{20}$ linear, branched or cyclic diene, or an ethylene vinyl compound, such as vinyl acetate, and a compound represented by the formula $H_2C{=}CHR$ wherein R is a $C_1$-$C_{20}$ linear, branched or cyclic alkyl group or a $C_6$-$C_{20}$ aryl group. Examples of comonomers include propylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the interpolymer of ethylene has a density of less than about 0.92 g/cc.

In other embodiments, the thermoplastic resin comprises an alpha-olefin interpolymer of propylene with at least one comonomer selected from the group consisting of ethylene, a $C_4$-$C_{20}$ linear, branched or cyclic diene, and a compound represented by the formula $H_2C{=}CHR$ wherein R is a $C_1$-$C_{20}$ linear, branched or cyclic alkyl group or a $C_6$-$C_{20}$ aryl group. Examples of comonomers include ethylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the comonomer is present at about 5% by weight to about 25% by weight of the interpolymer. In one embodiment, a propylene-ethylene interpolymer is used.

Other examples of thermoplastic resins which may be used in the present disclosure include homopolymers and copolymers (including elastomers) of an olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene as typically represented by ethylene-butadiene copolymer and ethylene-ethylidene norbornene copolymer; and polyolefins (including elastomers) such as copolymers of two or more alpha-olefins with a conjugated or non-conjugated diene as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymers with N-methylol functional comonomers, ethylene-vinyl alcohol copolymers with N-methylol functional comonomers, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, methylstyrene-styrene copolymer; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like. These resins may be used either alone or in combinations of two or more.

In particular embodiments, polyolefins such as polypropylene, polyethylene, and copolymers thereof and blends thereof, as well as ethylene-propylene-diene terpolymers are used. In some embodiments, the olefinic polymers include homogeneous polymers described in U.S. Pat. No. 3,645,992 by Elston; high density polyethylene (HDPE) as described in U.S. Pat. No. 4,076,698 to Anderson; heterogeneously branched linear low density polyethylene (LLDPE); heterogeneously branched ultra low linear density (ULDPE); homogeneously branched, linear ethylene/alpha-olefin copolymers; homogeneously branched, substantially linear ethylene/alpha-olefin polymers which can be prepared, for example, by a process disclosed in U.S. Pat. Nos. 5,272,236 and 5,278,272, the disclosure of which process is incorporated herein by reference; and high pressure, free radical polymerized ethylene polymers and copolymers such as low density polyethylene (LDPE). In still another embodiment of the present invention, the thermoplastic resin comprises an ethylene-carboxylic acid copolymer, such as ethylene-acrylic acid (EAA) and ethylene-methacrylic acid copolymers such as for example those available under the tradenames PRIMACOR™ from The Dow Chemical Company, NUCREL™ from DuPont, and ESCOR™ from ExxonMobil, and described in U.S. Pat. Nos. 4,599,392, 4,988,781, and 5,384,373, each of which is incorporated herein by reference in its entirety, and ethylene-vinyl acetate (EVA) copolymers. Polymer compositions described in U.S. Pat. Nos. 6,538,070, 6,566,446, 5,869,575, 6,448,341, 5,677,383, 6,316,549, 6,111,023, or 5,844,045, each of which is incorporated herein by reference in its entirety, are also suitable in some embodiments. Of course, blends of polymers can be used as well. In some embodiments, the blends include two different Ziegler-Natta polymers. In other embodiments, the blends can include blends of a Ziegler-Natta and a metallocene polymer. In still other embodiments, the thermoplastic resin used herein is a blend of two different metallocene polymers.

In one particular embodiment, the thermoplastic resin comprises an alpha-olefin interpolymer of ethylene with a comonomer comprising an alkene, such as 1-octene. The ethylene and octene copolymer may be present alone in the additive composition or in combination with another thermoplastic resin, such as ethylene-acrylic acid copolymer. Of particular advantage, the ethylene-acrylic acid copolymer not only is a thermoplastic resin, but also serves as a dispersing agent. For some embodiments, the additive composition should comprise a film-forming composition. It has been found that the ethylene-acrylic acid copolymer may assist in forming films, while the ethylene and octene copolymer lowers the stiffness. When applied to a tissue web, the composition may or may not form a film on the product, depending upon how the composition is applied and the amount of the composition that is applied. When forming a film on the tissue web, the film may be continuous or discontinuous. When present together, the weight ratio between the ethylene and octene copolymer and the ethylene-acrylic acid copolymer may be from about 1:10 to about 10:1, such as from about 3:2 to about 2:3.

The thermoplastic resin, such as the ethylene and octene copolymer, may have a crystallinity of less than about 50%, such as less than about 25%. The polymer may have been produced using a single site catalyst and may have a weight average molecular weight of from about 15,000 to about 5 million, such as from about 20,000 to about 1 million. The molecular weight distribution of the polymer may be from about 1.01 to about 40, such as from about 1.5 to about 20, such as from about 1.8 to about 10.

Depending upon the thermoplastic polymer, the melt index of the polymer may range from about 0.001 g/10 min to about 1,000 g/10 min, such as from about 0.5 g/10 min to about 800 g/10 min. For example, in one embodiment, the melt index of the thermoplastic resin may be from about 100 g/10 min to about 700 g/10 min.

The thermoplastic resin may also have a relatively low melting point. For instance, the melting point of the thermoplastic resin may be less than about 140° C., such as less than 130° C., such as less than 120° C. For instance, in one embodiment, the melting point may be less than about 90° C. The glass transition temperature of the thermoplastic resin may also be relatively low. For instance, the glass transition temperature may be less than about 50° C., such as less than about 40° C.

The one or more thermoplastic resins may be contained within the additive composition in an amount from about 1% by weight to about 96% by weight. For instance, the thermoplastic resin may be present in the aqueous dispersion in an amount from about 10% by weight to about 70% by weight, such as from about 20% to about 50% by weight.

In addition to at least one thermoplastic resin, the aqueous dispersion may also contain a dispersing agent. A dispersing agent is an agent that aids in the formation and/or the stabilization of the dispersion. One or more dispersing agents may be incorporated into the additive composition.

In general, any suitable dispersing agent can be used. In one embodiment, for instance, the dispersing agent comprises at least one carboxylic acid, a salt of at least one carboxylic acid, or carboxylic acid ester or salt of the carboxylic acid ester. Examples of carboxylic acids useful as a dispersant comprise fatty acids such as montanic acid, stearic acid, oleic acid, and the like. In some embodiments, the carboxylic acid, the salt of the carboxylic acid, or at least one carboxylic acid fragment of the carboxylic acid ester or at least one carboxylic acid fragment of the salt of the carboxylic acid ester has fewer than 25 carbon atoms. In other embodiments, the carboxylic acid, the salt of the carboxylic acid, or at least one carboxylic acid fragment of the carboxylic acid ester or at least one carboxylic acid fragment of the salt of the carboxylic acid ester has 12 to 25 carbon atoms. In some embodiments, carboxylic acids, salts of the carboxylic acid, at least one carboxylic acid fragment of the carboxylic acid ester or its salt has 15 to 25 carbon atoms are preferred. In other embodiments, the number of carbon atoms is 25 to 60. Some examples of salts comprise a cation selected from the group consisting of an alkali metal cation, alkaline earth metal cation, or ammonium or alkyl ammonium cation.

In still other embodiments, the dispersing agent is selected from the group consisting of ethylene-carboxylic acid polymers, and their salts, such as ethylene-acrylic acid copolymers or ethylene-methacrylic acid copolymers.

In other embodiments, the dispersing agent is selected from alkyl ether carboxylates, petroleum sulfonates, sulfonated polyoxyethylenated alcohol, sulfated or phosphated polyoxyethylenated alcohols, polymeric ethylene oxide/propylene oxide/ethylene oxide dispersing agents, primary and secondary alcohol ethoxylates, alkyl glycosides and alkyl glycerides.

When ethylene-acrylic acid copolymer is used as a dispersing agent, the copolymer may also serve as a thermoplastic resin.

In one particular embodiment, the aqueous dispersion contains an ethylene and octene copolymer, ethylene-acrylic acid copolymer, and a fatty acid, such as stearic acid or oleic acid. The dispersing agent, such as the carboxylic acid, may be present in the aqueous dispersion in an amount from about 0.1% to about 10% by weight.

In addition to the above components, the aqueous dispersion also contains water. Water may be added as deionized water, if desired. The pH of the aqueous dispersion is generally less than about 12, such as from about 5 to about 11.5, such as from about 7 to about 11. The aqueous dispersion may have a solids content of less than about 75%, such as less than about 70%. For instance, the solids content of the aqueous dispersion may range from about 5% to about 60%. In general, the solids content can be varied depending upon the manner in which the additive composition is applied or incorporated into the tissue web. For instance, when incorporated into the tissue web during formation, such as by being added with an aqueous suspension of fibers, a relatively high solids content can be used. When topically applied such as by spraying or printing, however, a lower solids content may be used in order to improve processability through the spray or printing device.

While any method may be used to produce the aqueous dispersion, in one embodiment, the dispersion may be formed through a melt-kneading process. For example, the kneader may comprise a Banbury mixer, single-screw extruder or a multi-screw extruder. The melt-kneading may be conducted under the conditions which are typically used for melt-kneading the one or more thermoplastic resins.

In one particular embodiment, the process includes melt-kneading the components that make up the dispersion. The melt-kneading machine may include multiple inlets for the various components. For example, the extruder may include four inlets placed in series. Further, if desired, a vacuum vent may be added at an optional position of the extruder.

In some embodiments, the dispersion is first diluted to contain about 1 to about 3% by weight water and then, subsequently, further diluted to comprise greater than about 25% by weight water.

When treating tissue webs in accordance with the present disclosure, the additive composition containing the aqueous polymer dispersion can be applied to the tissue web topically or can be incorporated into the tissue web by being pre-mixed with the fibers that are used to form the web. When applied topically, the additive composition can be applied to the tissue web when wet or dry. In one embodiment, the additive composition may be applied topically to the web during a creping process. For instance, in one embodiment, the additive composition may be sprayed onto the web or onto a heated dryer drum in order to adhere the web to the dryer drum. The web can then be creped from the dryer drum. When the additive composition is applied to the web and then adhered to the dryer drum, the additive composition may be uniformly applied over the surface area of the web or may be applied according to a particular pattern.

When topically applied to a tissue web, the additive composition may be sprayed onto the web, extruded onto the web, or printed onto the web. When extruded onto the web, any suitable extrusion device may be used, such as a slot-coat extruder or a meltblown dye extruder. When printed onto the web, any suitable printing device may be used. For example, an inkjet printer or a rotogravure printing device may be used.

In one embodiment, the additive composition may be heated prior to or during application to a tissue web. Heating the composition can lower the viscosity for facilitating application. For instance, the additive composition may be heated to a temperature of from about 50° C. to about 150° C.

Tissue products made according to the present disclosure may include single-ply tissue products or multiple-ply tissue products. For instance, in one embodiment, the product may include two plies, three plies or even more.

In general, any suitable tissue web may be treated in accordance with the present disclosure. For example, in one embodiment, the base sheet can be a tissue product, such as a bath tissue, a facial tissue, a paper towel, an industrial wiper, and the like. Tissue products typically have a bulk of at least 3 cc/g. The tissue products can contain one or more plies and can be made from any suitable types of fiber.

Fibers suitable for making tissue webs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988 to Laamanen et al.; U.S. Pat. No. 4,594,130, issued Jun. 10, 1986 to Chang et al.; and U.S. Pat. No. 3,585,104. Useful fibers can also be produced by anthraquinone pulping, exemplified by U.S. Pat. No. 5,595,628 issued Jan. 21, 1997, to Gordon et al.

A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Fybrel®, available from Minifibers, Inc. (Jackson City, Tenn.). Any known bleaching method can be used. Synthetic cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

In general, any process capable of forming a paper web can also be utilized in the present disclosure. For example, a papermaking process of the present disclosure can utilize creping, wet creping, double creping, embossing, wet pressing, air pressing, through-air drying, creped through-air drying, uncreped through-air drying, coform, hydroentangling, air laying, as well as other steps known in the art.

Also suitable for products of the present disclosure are tissue sheets that are pattern densified or imprinted, such as the tissue sheets disclosed in any of the following U.S. Pat. No. 4,514,345 issued on Apr. 30, 1985, to Johnson et al.; U.S. Pat. No. 4,528,239 issued on Jul. 9, 1985, to Trokhan; U.S. Pat. No. 5,098,522 issued on Mar. 24, 1992; U.S. Pat. No. 5,260,171 issued on Nov. 9, 1993, to Smurkoski et al.; U.S. Pat. No. 5,275,700 issued on Jan. 4, 1994, to Trokhan; U.S. Pat. No. 5,328,565 issued on Jul. 12, 1994, to Rasch et al.; U.S. Pat. No. 5,334,289 issued on Aug. 2, 1994, to Trokhan et al.; U.S. Pat. No. 5,431,786 issued on Jul. 11, 1995, to Rasch et al.; U.S. Pat. No. 5,496,624 issued on Mar. 5, 1996, to Steltjes, Jr. et al.; U.S. Pat. No. 5,500,277 issued on Mar. 19, 1996, to Trokhan et al.; U.S. Pat. No. 5,514,523 issued on May 7, 1996, to Trokhan et al.; U.S. Pat. No. 5,554,467 issued on Sep. 10, 1996, to Trokhan et al.; U.S. Pat. No. 5,566,724 issued on Oct. 22, 1996, to Trokhan et al.; U.S. Pat. No. 5,624,790 issued on Apr. 29, 1997, to Trokhan et al.; and, U.S. Pat. No. 5,628,876 issued on May 13, 1997, to Ayers et al., the disclosures of which are incorporated herein by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits was deflected by an air pressure differential across the deflection conduit to form a lower-density pillow-like region or dome in the tissue sheet.

The tissue web can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one embodiment, the debonding agent used in the process of the present disclosure is an organic quaternary ammonium chloride and, particularly, a silicone-based amine salt of a quaternary ammonium chloride. For example, the debonding agent can be PROSOFT® TQ1003, marketed by the Hercules Corporation. The debonding agent can be added to the fiber slurry in an amount of from about 1 kg per metric tonne to about 10 kg per metric tonne of fibers present within the slurry.

In an alternative embodiment, the debonding agent can be an imidazoline-based agent. The imidazoline-based debonding agent can be obtained, for instance, from the Witco Corporation. The imidazoline-based debonding agent can be added in an amount of between 2.0 to about 15 kg per metric tonne.

In one embodiment, the debonding agent can be added to the fiber furnish according to a process as disclosed in PCT Application having an International Publication No. WO 99/34057 filed on Dec. 17, 1998 or in PCT Published Application having an International Publication No. WO 00/66835 filed on Apr. 28, 2000, which are both incorporated herein by reference. In the above publications, a process is disclosed in which a chemical additive, such as a debonding agent, is adsorbed onto cellulosic papermaking fibers at high levels. The process includes the steps of treating a fiber slurry with an excess of the chemical additive, allowing sufficient residence time for adsorption to occur, filtering the slurry to remove unadsorbed chemical additives, and redispersing the filtered pulp with fresh water prior to forming a web.

Optional chemical additives may also be added to the aqueous papermaking furnish or to the formed embryonic web to impart additional benefits to the product and process and are not antagonistic to the intended benefits of the invention. The following materials are included as examples of additional chemicals that may be applied to the web along with the additive composition of the present invention. The chemicals are included as examples and are not intended to limit the scope of the invention. Such chemicals may be added at any point in the papermaking process, including being added simultaneously with the additive composition in the pulp making process, wherein said additive or additives are blended directly with the additive composition.

Additional types of chemicals that may be added to the paper web include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin E, silicone, lotions in general and the like may also be incorporated into the finished products.

In general, the products of the present invention can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, humectants, emollients, and the like.

Tissue webs that may be treated in accordance with the present disclosure may include a single homogenous layer of fibers or may include a stratified or layered construction. For instance, the tissue web ply may include two or three layers of fibers. Each layer may have a different fiber composition. For example, referring to FIG. 1, one embodiment of a device for forming a multi-layered stratified pulp furnish is illustrated. As shown, a three-layered headbox 10 generally includes an upper head box wall 12 and a lower head box wall 14. Headbox 10 further includes a first divider 16 and a second divider 18, which separate three fiber stock layers.

Each of the fiber layers comprise a dilute aqueous suspension of papermaking fibers. The particular fibers contained in each layer generally depends upon the product being formed and the desired results. For instance, the fiber composition of each layer may vary depending upon whether a bath tissue product, facial tissue product or paper towel is being produced. In one embodiment, for instance, middle layer 20 contains southern softwood kraft fibers either alone or in combination with other fibers such as high yield fibers. Outer layers 22 and 24, on the other hand, contain softwood fibers, such as northern softwood kraft.

In an alternative embodiment, the middle layer may contain softwood fibers for strength, while the outer layers may comprise hardwood fibers, such as eucalyptus fibers, for a perceived softness.

An endless traveling forming fabric 26, suitably supported and driven by rolls 28 and 30, receives the layered papermaking stock issuing from headbox 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988 to Farrington, Jr., which is incorporated herein by reference.

In accordance with the present disclosure, the additive composition, in one embodiment, may be combined with the aqueous suspension of fibers that are fed to the headbox 10. The additive composition, for instance, may be applied to only a single layer in the stratified fiber furnish or to all layers. When added during the wet end of the process or otherwise combined with the aqueous suspension of fibers, the additive composition becomes incorporated throughout the fibrous layer.

When combined at the wet end with the aqueous suspension of fibers, a retention aid may also be present within the additive composition. For instance, in one particular embodiment, the retention aid may comprise polydiallyl dimethyl ammonium chloride. The additive composition may be incorporated into the tissue web in an amount from about 0.01% to about 30% by weight, such as from about 0.5% to about 20% by weight. For instance, in one embodiment, the additive composition may be present in an amount up to about 10% by weight. The above percentages are based upon the solids that are added to the tissue web.

The basis weight of tissue webs made in accordance with the present disclosure can vary depending upon the final product. For example, the process may be used to produce bath tissues, facial tissues, paper towels, industrial wipers, and the like. In general, the basis weight of the tissue products may vary from about 10 gsm to about 110 gsm, such as from about 20 gsm to about 90 gsm. For bath tissue and facial tissues, for instance, the basis weight may range from about 10 gsm to about 40 gsm. For paper towels, on the other hand, the basis weight may range from about 25 gsm to about 80 gsm.

The tissue web bulk may also vary from about 3 cc/g to 20 cc/g, such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In multiple ply products, the basis weight of each tissue web present in the product can also vary. In general, the total basis weight of a multiple ply product will generally be the same as indicated above, such as from about 20 gsm to about 110 gsm. Thus, the basis weight of each ply can be from about 10 gsm to about 60 gsm, such as from about 20 gsm to about 40 gsm.

Figure 2:
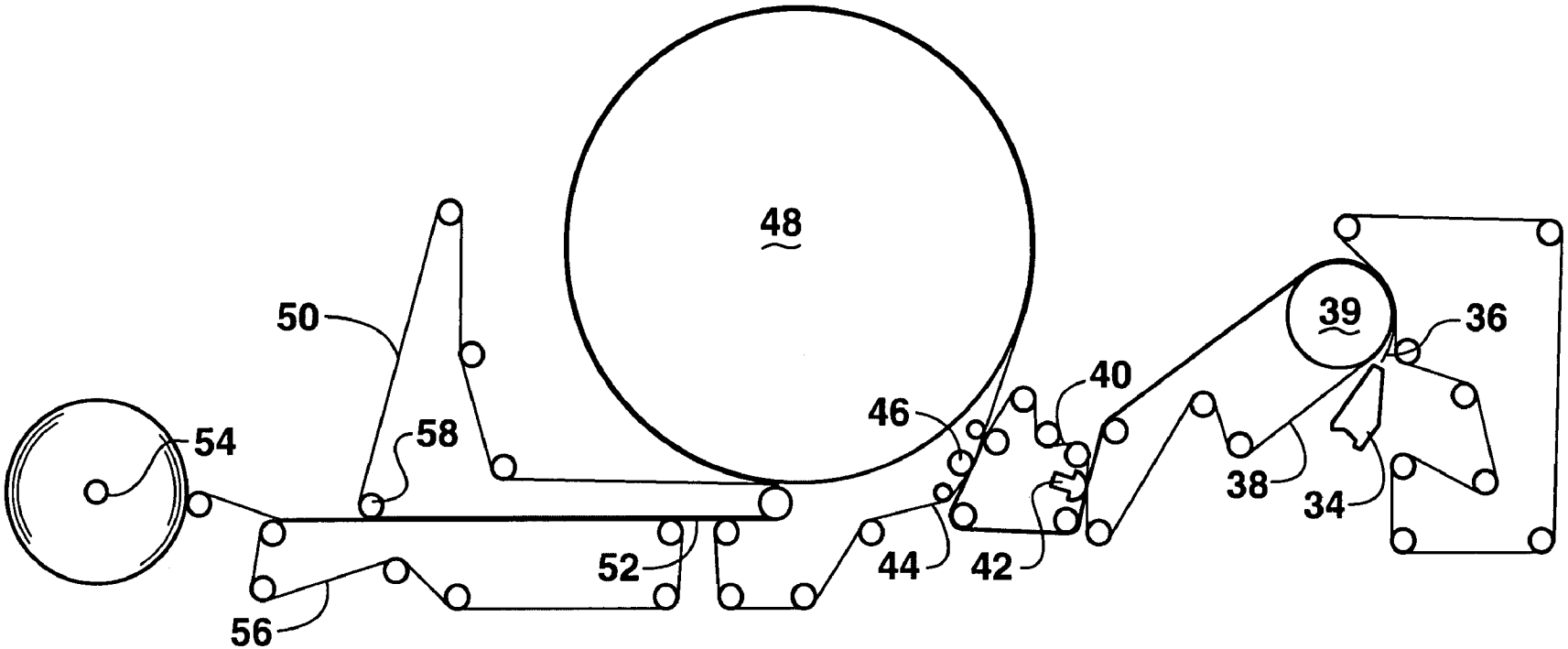
FIGS. 2 and 3 are schematic diagrams of embodiments of processes for forming uncreped through-dried tissue webs for use in the present disclosure.

Once the aqueous suspension of fibers is formed into a tissue web, the tissue web may be processed using various techniques and methods. For example, referring to FIG. 2, shown is a method for making throughdried tissue sheets. (For simplicity, the various tensioning rolls schematically used to define the several fabric runs are shown, but not numbered. It will be appreciated that variations from the apparatus and method illustrated in FIG. 2 can be made without departing from the general process). Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. Preferably the transfer fabric can have a void volume that is equal to or less than that of the forming fabric. The relative speed difference between the two fabrics can be from 0-60 percent, more specifically from about 15-45 percent. Transfer is preferably carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and appearance if desired. Suitable throughdrying fabrics are described in U.S. Pat. No. 5,429,686 issued to Kai F. Chiu et al. and U.S. Pat. No. 5,672,248 to Wendt, et al. which are incorporated by reference.

In one embodiment, the throughdrying fabric contains high and long impression knuckles. For example, the throughdrying fabric can have about from about 5 to about 300 impression knuckles per square inch which are raised at least about 0.005 inches above the plane of the fabric. During drying, the web can be macroscopically arranged to conform to the surface of the throughdrying fabric and form a three-dimensional surface. Flat surfaces, however, can also be used in the present disclosure.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web is typically smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is finally dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

In one embodiment, the paper web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. Processes for producing uncreped throughdried fabrics are, for instance,. disclosed in U.S. Pat. No. 5,672,248 to Wendt, et al.; U.S. Pat. No. 5,656,132 to Farrington, et al.; U.S. Pat. No. 6,120,642 to Lindsay and Burazin; U.S. Pat. No. 6,096,169 to Hermans, et al.; U.S. Pat. No. 6,197,154 to Chen, et al.;

and U.S. Pat. No. 6,143,135 to Hada, et al., all of which are herein incorporated by reference in their entireties.

As described above, the additive composition can be combined with the aqueous suspension of fibers used to form the tissue web 52. Alternatively, the additive composition may be topically applied to the tissue web after it has been formed. For instance, as shown in FIG. 2, the additive composition may be applied to the tissue web prior to the dryer 48 or after the dryer 48.

The additive composition can be applied to the tissue web using various methods and techniques. For instance, the additive composition can be applied directly to the web by spraying, printing or extruding the composition onto the web. Alternatively, the additive composition can be indirectly applied to the tissue web. For instance, in one embodiment, the additive composition can be applied to the transfer fabric 40 and/or to the carrier fabric 50 and/or the carrier fabric 56 for transfer to the tissue web.

Figure 3:
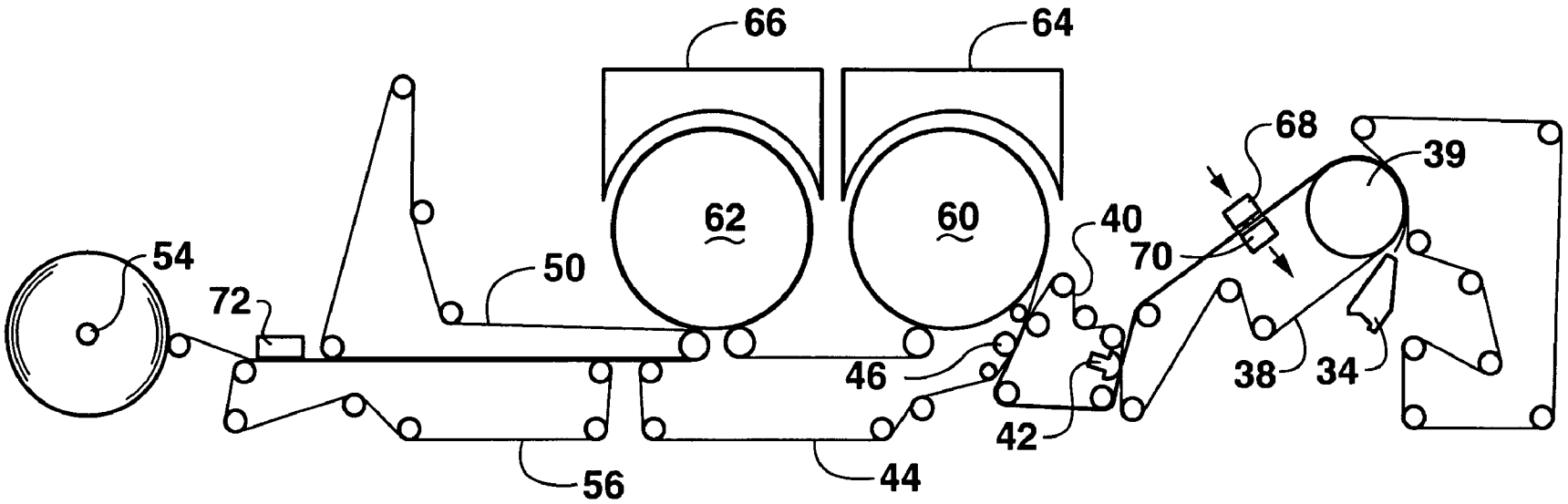

Referring to FIG. 3, another process flow diagram of a drying process in accordance with the present disclosure is illustrated. The process illustrated in FIG. 3 is similar to the process described in U.S. Pat. No. 6,736,935, which is incorporated herein by reference. The process illustrated in FIG. 3 is also similar to the process shown in FIG. 2. Thus, common reference numerals have been used to indicated similar elements.

In the embodiment illustrated in FIG. 3, however, the process, as opposed to containing a single through-air dryer, contains two through-air dryers 60 and 62 which are arranged in series. It should be understood, that greater than two through-air dryers may also be used.

In the embodiment shown in FIG. 3, a first hood 64 is shown over the first through-air dryer 60 and a second hood 66 is shown over the second through-air dryer 62. As explained above, hot air is used to dry the tissue web while passing over the through-air dryers 60 and 62. For instance, in one embodiment, a burner may produce hot air that is then distributed over the surface of the drum of the through-air dryer using the hoods 60 and 64. Air is drawn through the wet tissue web into the interior of the drum by a fan which serves to circulate the air back to the burner.

In addition to the second through-air dryer 62, the process illustrated in FIG. 3 also includes a steam box 68 positioned opposite a vacuum suction box 70. The steam box 68 in conjunction with the vacuum suction box 70 provide for additional de-watering of the wet tissue as the web is carried on the forming fabric 38.

If desired, the process shown in FIG. 3 can also include an auxiliary dryer 72. The auxiliary dryer 72 may be for drying the formed tissue web to a finer moisture content of about 5% or less, such as less than about 4%, such as less than about 3%, such as less than about 2%.

When forming tissue webs according to the process shown in FIG. 3, the additive composition of the present disclosure can be applied at one or multiple locations. In one embodiment, for instance, the additive composition may be applied in between the first through-air dryer 60 and the second through-air dryer 62 while the web is being supported by the through-air dryer fabric 44. In this embodiment, the consistency of the web exiting the through-air dryer 60 as it treated with the additive composition can be greater than about 40%, such as greater than 45%, such as greater than about 50%. For instance, the consistency of the web between the through-air dryers may be from about 40% to about 80%. The additive composition can be applied to the tissue web using any of the methods and techniques described above. For instance, in one embodiment, the additive composition can be applied directly to the web or, alternatively, can be transferred to the web by applying the additive composition to a fabric that carries the web between the through-air dryers.

In another embodiment, the additive composition can be applied to the tissue web between the second through-air dryer 62 and the reel 54. For instance, the additive composition can be applied to the tissue web while the web is being supported by the fabric 50, especially in the open area between the fabric 44 and the fabric 56. Alternatively, the additive composition can be applied to a fabric, such as the fabric 56, for transfer to the tissue web prior to the reel 54.

Figure 4:
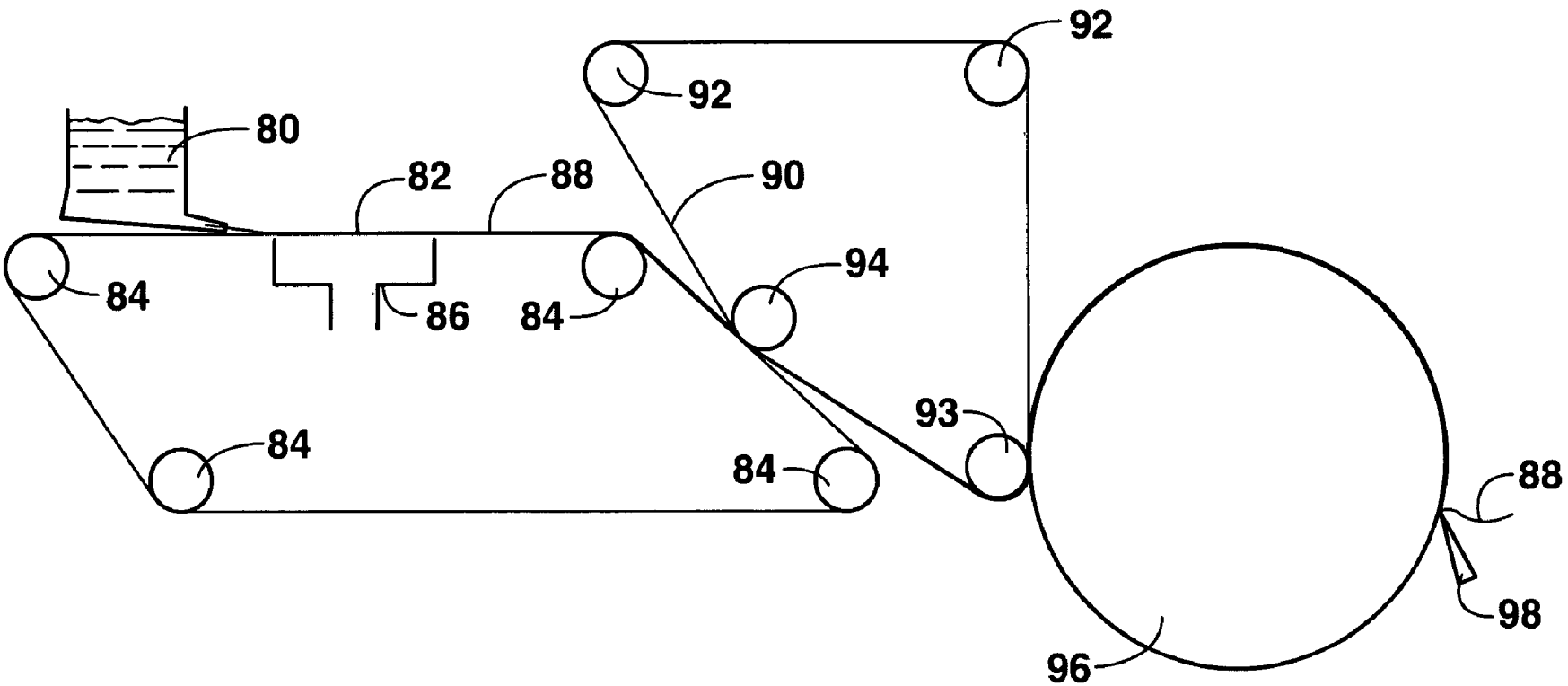
FIG. 4 is a schematic diagram of one embodiment of a process for forming wet or dry creped tissue webs for use in the present disclosure.

In FIG. 2, a process is shown for producing uncreped through-air dried tissue webs. It should be understood, however, that the additive composition may be applied to tissue webs in other tissue making processes. For example, referring to FIG. 4, one embodiment of a process for forming wet or dry creped tissue webs is shown. In this embodiment, a headbox 80 emits an aqueous suspension of fibers onto a forming fabric 82 which is supported and driven by a plurality of guide rolls 84. A vacuum box 86 is disposed beneath forming fabric 82 and is adapted to remove water from the fiber furnish to assist in forming a web. From forming fabric 82, a formed web 88 is transferred to a second fabric 90, which may be either a wire or a felt. Fabric 90 is supported for movement around a continuous path by a plurality of guide rolls 92. Also included is a pick up roll 94 designed to facilitate transfer of web 88 from fabric 82 to fabric 90.

From fabric 90, web 88, in this embodiment, is transferred to the surface of a rotatable heated dryer drum 96, such as a Yankee dryer with the assistance of a press roll 93.

In accordance with the present disclosure, the additive composition can be incorporated into the tissue web 88 by being combined with an aqueous suspension of fibers contained in the headbox 80 and/or by topically applying the additive composition during the process. In one particular embodiment, the additive composition of the present disclosure may be applied topically to the tissue web 88 while the web is traveling on the fabric 90 or may be applied to the surface of the dryer drum 96 for transfer onto one side of the tissue web 88. In this manner, the additive composition is used to adhere the tissue web 88 to the dryer drum 96. In this embodiment, as web 88 is carried through a portion of the rotational path of the dryer surface, heat is imparted to the web causing most of the moisture contained within the web to be evaporated. Web 88 is then removed from dryer drum 96 by a creping blade 98. Creping web 88 as it is formed further reduces internal bonding within the web and increases softness. Applying the additive composition to the web during creping, on the other hand, may increase the strength of the web.

Figure 5:
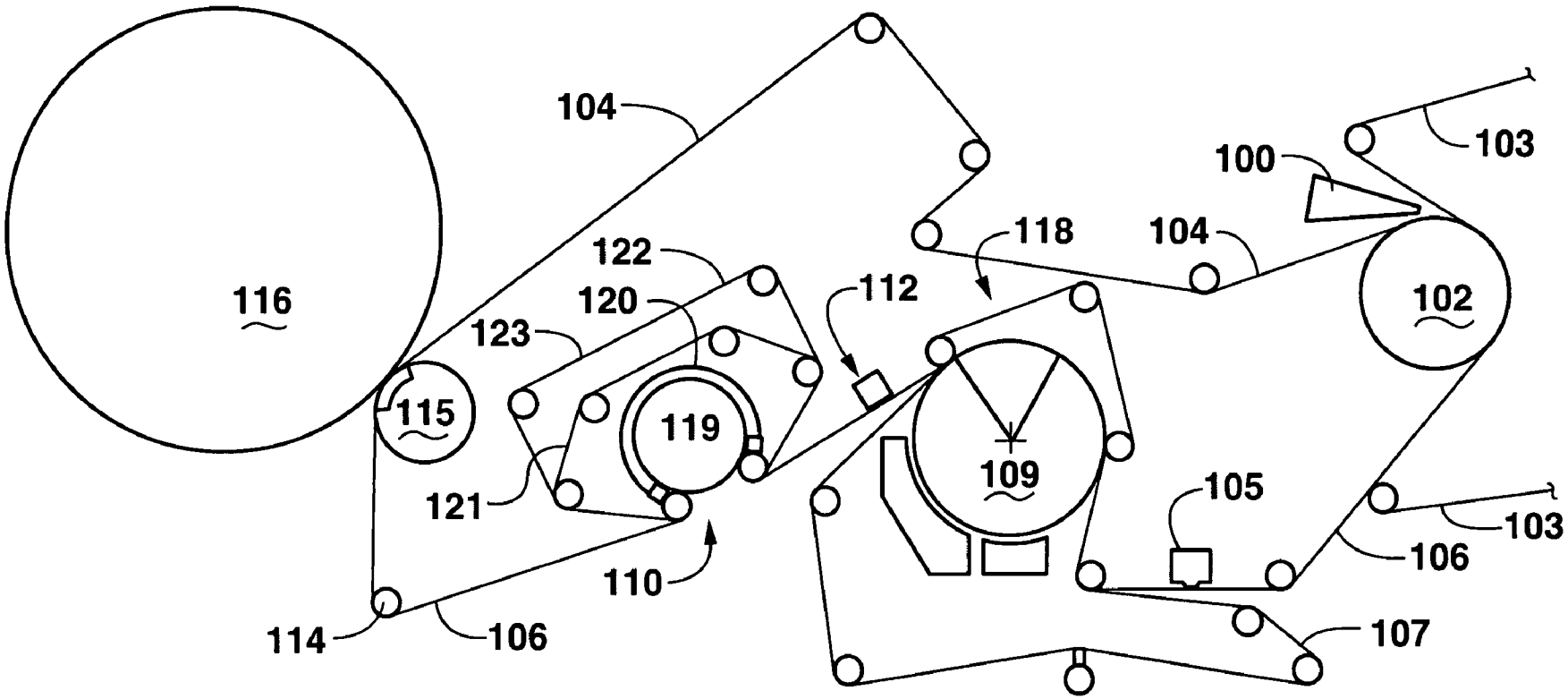
FIGS. 5-7 are schematic diagrams of alternative processes for producing tissue webs that may be used in the present disclosure.

Referring to FIG. 5, another embodiment of a tissue making system that may be used in accordance with the present disclosure is illustrated. The tissue making system shown in FIG. 5 includes an advanced de-watering device that de-waters the web prior to contacting the web with a dryer.

As shown in FIG. 5, the process includes a head box 100 that emits an aqueous suspension of fibers in between a structured fabric 104 and a forming fabric 103. The fabrics converge on a forming roll 102 which can be a solid roll or a suction forming roll.

After the aqueous suspension of fibers is deposited onto the structured fabric 104 and drained, a tissue web 106 is formed. The tissue web is then fed to a de-watering system such as disclosed in U.S. Patent Publication No. 2006/0085998 to Herman, which is incorporated herein by reference.

As shown in FIG. 5, the de-watering system utilizes a main pressure field in the form of a press belt 118. The tissue web 106 is carried by the structured fabric 104 and placed in contact with a vacuum box 105. In FIG. 5, the tissue web 106 is carried by the structured fabric 104 under the vacuum box 105. In an alternative embodiment, however, the tissue web may be carried over a vacuum box by the structured fabric. The vacuum box is optional but can be used to achieve a consistency in the tissue web of from about 15% to about 25%.

After passing under the vacuum box 105, the tissue web 106 is then fed in between the structured fabric 104 and a de-watering fabric 107. While positioned between the structured fabric 104 and the de-watering fabric 107, the tissue web 106 is fed around a vacuum roll 109. The vacuum roll 109, for instance, can operate at a vacuum level of between about −0.2 and about −0.8 bar. A belt press 118 can be used to apply further pressure to the structured fabric 104 on a side opposite the fabric that is in contact with the tissue web 106. The press belt 118 can comprise, for instance, an endless conveyor. The press belt 118 can also assist in carrying the tissue web 106 around the vacuum roll 109. If desired, a hot air hood (not shown) can also be arranged in operative association with the press belt 118 and positioned over the vacuum roll 109 in order to further assist in de-watering the tissue web 106.

As shown in FIG. 5, the vacuum roll 109 can include at least one vacuum zone that exposes the tissue web 106 to a suction force. The vacuum zone can have a circumferential length from about 200 mm to about 2500 mm or larger.

As the tissue web 106 passes around the vacuum roll 109, a vacuum box 112 can be used to ensure that the tissue web remains adjacent to the structured fabric 104 and is separated from the de-watering fabric 107. As shown in FIG. 5, in one embodiment, the vacuum boxes 105 and 112 have a direction of air flow that is opposite to the direction of air flow through the vacuum roll 109.

As the tissue web 106 exits the vacuum roll 109, the tissue web can be dried so as to have a consistency of at least 25%. For instance, the consistency of the tissue web exiting the vacuum roll 109 can be at least 30%, at least 35%, at least 40%, at least 45%, or even at least 50%. In one embodiment, the consistency of the tissue web exiting the vacuum roll 109 can be at least 55%.

The press belt 118 as shown in FIG. 5 can have a substantial impact in de-watering the tissue web 106. In general, the press belt 118 can be made from any suitable belt material that is porous. In general, the press belt 118 should be capable of sustaining belt tension of at least about 20 KN/m such as at least about 50 KN/m, such as at least about 80 KN/m. The press belt may be, for instance, a pin seamable belt, a spiral link fabric, a stainless steel metal belt and the like.

Specific examples of materials that may be used to form the press belt 118, the de-watering fabric 107, and the structured fabric 104 are described in U.S. Patent Publication No. 2006/0085998 A1 entitled "Advanced De-watering System", which is incorporated herein by reference. The de-watering fabric 107, for instance, can have a relatively thin construction and can be, for instance, a needle punched press fabric made from multiple layers of bat fiber. Alternatively, the de-watering fabric 107 can be a woven-based cloth laminated to an anti-rewet layer.

From the vacuum roll 109, the tissue web 106 is directed by the vacuum box 112 optionally into a boost dryer 110. As shown, the tissue web 106 is fed around the boost dryer 110 and is brought in contact with the heated surface of a dryer roll 119 while being conveyed by the structured fabric 104. A woven fabric 122 can ride on top of the structured fabric 104 around the boost dryer roll 119. On top of the woven fabric 122 can be a further metal fabric 121 which is in contact with both the woven fabric 122 and a cooling jacket 120. The cooling jacket 120 applies pressure to the structured fabric 104, the woven fabric 122, the metal fabric 121, and the tissue web 106. A structured fabric 104 can be selected that can be configured to absorb the body of the tissue web so that the high basis weight areas of the web are protected from the pressure being applied by the cooling jacket 120. As a result, this pressing arrangement does not substantially impact on web bulk but instead increases the drying rate of the boost dryer 110.

The fabrics 104, 122 and 124 provide sufficient pressure to hold the tissue web 106 against the hot surface of the dryer roll 119 thus preventing blistering. The steam that is formed in the structured fabric 104, which passes through the woven fabric 122, is condensed on the metal fabric 121. The metal fabric 121 can be made from a high thermal conductive material. The metal fabric 121, thus, is maintained at a temperature well below that of the steam. The condensed water is then captured in the woven fabric 122 and subsequently de-watered using a de-watering apparatus 123.

Once exiting the boost dryer 110, the tissue web 106 is fed around a turning roll 114 and pressed onto a drying cylinder 116. The drying cylinder 116 can be, for instance, a Yankee dryer. A pressure roll 115 can be used to apply the tissue web to the drying cylinder 116. The pressure roll 115, for instance, may comprise a shoe press.

Once pressed against the drying cylinder 116, the tissue web 106 travels over the surface of the cylinder for a significant portion of the circumference of the cylinder. If desired, the tissue web can be creped from the surface of the drying cylinder 116 and fed to a take up reel.

In accordance with the present disclosure, the additive composition can be applied at one or more locations within the process illustrated in FIG. 5. For example, in one embodiment, the additive composition of the present disclosure can be applied to the tissue web 106 between the vacuum roll 109 and the boost dryer 110. For instance, the additive composition can be sprayed or printed directly onto the tissue web. Alternatively, the additive composition can be applied to the structured fabric 104 which then transfers to a surface of the tissue web.

Additionally, the additive composition can be applied to the tissue web 106 within the boost dryer 110. For instance, in one embodiment, the additive composition can be sprayed or printed onto the boost dryer for transfer to one side of the tissue web 106.

In still another embodiment, the additive composition of the present disclosure can be applied to the tissue web 106 at the drying cylinder 116. In this embodiment, for instance, the additive composition can be applied to the surface of the drying cylinder 116 or applied to the tissue web 106 and used to adhere the tissue web to the drying cylinder.

Figure 6:
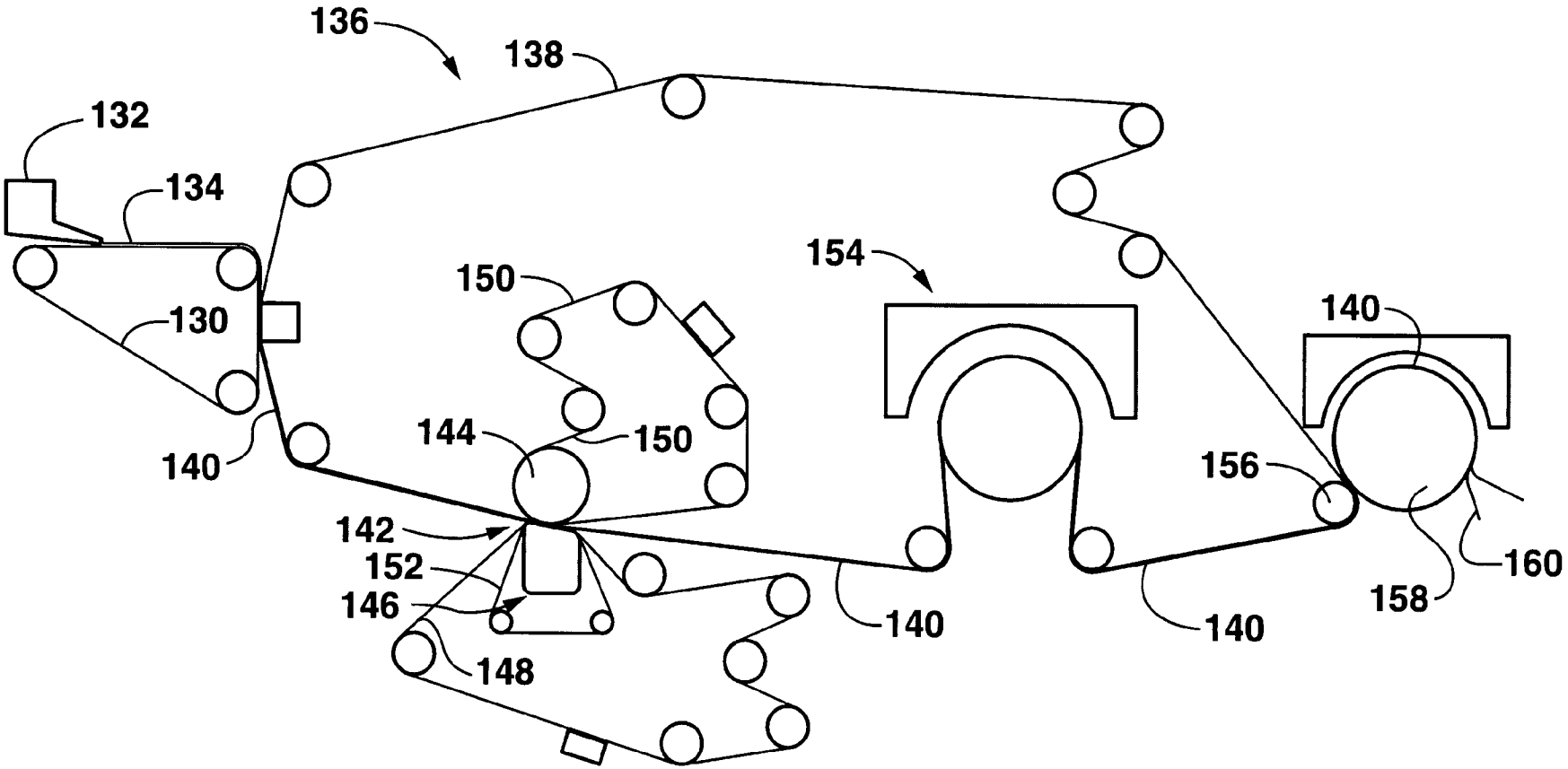

Still another embodiment of a process that may be used to produce tissue webs in accordance with the present disclosure is illustrated in FIG. 6 as will be described in more detail below. In the process shown in FIG. 6, a wet tissue web is fed into a compression nip for de-watering the web prior to conveying the web to one or more drying devices.

More particularly, an aqueous suspension of paper making fibers is applied to a forming conveyor, such as a forming fabric 130 from a head box 132. On the forming fabric 130, a tissue web 134 is formed and partially drained. From the forming fabric 130, the tissue web 134 is transferred with the help of a vacuum box to another conveyor 136. The conveyor 136 may comprise, for instance, a fabric that may be used to imprint a pattern into the tissue web. The imprinting conveyor 136 includes a first web contacting surface 138 comprising a web imprinting surface and a deflection conduit portion. A portion of the paper making fibers in the wet tissue web are deflected into the deflection conduit portion of the imprinting conveyor 136 without densifying the web, thereby forming a non-monoplanar intermediate web 140.

The tissue web 140 is carried on the imprinting conveyor 136 from the forming fabric 130 to a compression nip 142. The nip 142 can have a machine direction length of at least about 3.0 inches and comprise opposed convex and concave compression surfaces, with the convex compression surface being provided by a press roll 144 and the opposed concave compression surface being provided by a shoe press assembly 146. Alternatively, the nip 142 can be formed between two press rolls.

The tissue web 140 is carried into the nip 142 supported on the imprinting conveyor 136. As shown in FIG. 6, a first de-watering felt layer 148, the tissue web 140, and the imprinting conveyor 136 are positioned intermediate a second de-watering felt layer 150 and a backing member 152 in the nip 142. The backing member 152 can, for instance, be in the form of a fabric of woven filaments.

The first de-watering felt layer 148 has a first surface positioned adjacent to the first face of the tissue web 140 in the nip 142. The tissue web contacting face 138 of the imprinting conveyor 136 is positioned adjacent to the second face of the tissue web 140 in the nip 142. The first de-watering felt layer 148 is positioned intermediate the tissue web 140 and the backing member 152 in the nip 142. As also illustrated, the second or opposite surface of the first de-watering felt layer 148 is positioned adjacent to the backing member 152.

Water passed from the tissue web 140 and received from the first de-watering felt layer 148 at the first surface can subsequently exit the second layer of the de-watering felt and openings present in the backing member 152. The openings in the backing member 152 provide a reservoir for the water received by the backing member from the first de-watering felt layer 148. As the water leaves the felt layer and enters the openings in the backing member 152, additional water can be received from the tissue web 140 by the first de-watering felt 148. Accordingly, the addition of the backing member 152 can increase the web de-watering capability of the press nip 142 without an additional vacuum apparatus.

As shown in FIG. 6, the tissue web 140 is pressed between the imprinting conveyor 136 and the first felt layer 148 in the compression nip 142 to further deflect a portion of the paper making fibers into the deflection conduit portion of the imprinting conveyor 136 and to densify a portion of the tissue web. Water pressed from the tissue web 140 exits the first face of the tissue web as described above. Additionally, water pressed from the tissue web 140 can also exit the second and opposite face of the web and pass through openings in the imprinting conveyor 136 to be received by the second de-watering felt layer 150. Accordingly, the tissue web 140 is effectively de-watered by removing water from both sides of the web, thereby forming a molded web from which substantial amounts of water have been removed.

At the exit of the compression nip 142, the first felt layer 148 can be separated from the molded tissue web 140, and the second felt layer 150 can be separated from the imprinting conveyor 136. Accordingly, after pressing in the nip 142, the water held in the first felt layer is isolated from the tissue web and the water held in the second felt layer 150 is isolated from the imprinting conveyor 136. This isolation helps to prevent re-wetting of the tissue web.

The molded tissue web 140 can be carried around the compression nip 142 on the imprinting conveyor 136. The molded tissue web can be pre-dryed in a through-air dryer 154 by directing heated air to pass through the molded web, and then through the imprinting conveyor 136, thereby further drying the tissue web. Alternatively, the through-air dryer 154 can be omitted.

The web imprinting surface of the imprinting conveyor 136 can then be impressed into the molded web 140 such as at a nip formed between a roll 156 and a dryer drum 158. The roll 156 can be a vacuum pressure roll or alternatively, can be a solid roll or a blind drilled roll.

Impressing the web imprinting surface into the molded tissue web can further densify the portions of the web associated with the web imprinting surface. The imprinted web 140 can then be dried on the dryer drum 158 and creped from the dryer drum by a doctor blade 160.

In accordance with the present disclosure, the additive composition can be applied to the tissue web at one or more places throughout the process illustrated in FIG. 6. For example, in one embodiment, the additive composition can be applied to the tissue web 140 after the compression nip 142 and prior to the through-air dryer 154, or between the through-air dryer 154 and the heated drying drum 158. In this embodiment the additive composition can be applied topically to the tissue web by being printed or sprayed onto the web. Alternatively, the additive composition can be applied to the fabric 136 for transfer to the web.

In an alternative embodiment, the additive composition can be applied to the tissue web at the drying drum or cylinder 158. In this embodiment, the additive composition can be applied to the tissue web prior to pressing the web against the surface of the dryer drum. Alternatively, the additive composition can be applied to the surface of the dryer drum for subsequent application to the tissue web. When applied to the dryer drum or cylinder, the additive composition can be sprayed or printed onto the drum.

In one embodiment, the through-air dryer 154 can be replaced with another heated dryer drum. In this embodiment, the additive composition can be applied to the tissue web at the intermediate heated drying drum as described above.

In still another embodiment, the press roll 144 can be replaced with a heated roll and the second de-watering felt layer 150 can be eliminated from the process. In this embodiment, the additive composition can be sprayed or printed onto the heated roll 144 for application to the tissue web.

Figure 7:
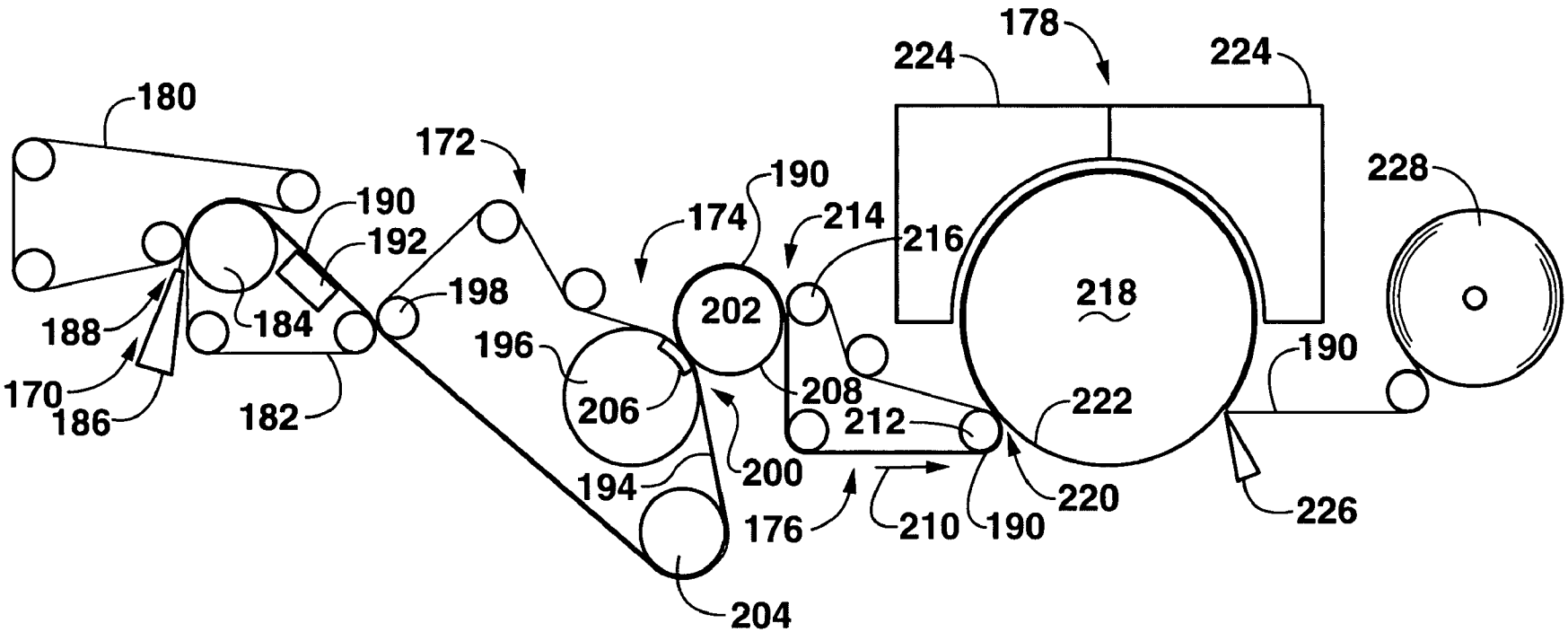

Referring to FIG. 7, still another embodiment of a paper making process that may be used in accordance with the present disclosure is shown. As illustrated, in this embodiment, the process includes a wire forming section 170, a felt run 172, a shoe press section 174, a creping fabric 176, and a drying device or system 178.

Referring to FIG. 7, still another embodiment of a process for producing tissue products in accordance with the present disclosure is illustrated. In this embodiment, the paper making process includes a forming section 170, a felt section 172, a press section 174, and a creping section 176 that includes a drying device 178, that can include, for instance, a Yankee dryer in conjunction with a hood. The forming section 170 can include a pair of forming fabrics 180 and 182 supported by a plurality of rolls including a forming roll 184. A head box 186 supplies an aqueous suspension of fibers into a nip 188 between the forming roll 184 and an opposing roll. The aqueous suspension of fibers forms a tissue web 190, which is de-watered on the fabrics with the assistance of vacuum, for example, by way of a vacuum box 192.

The tissue web is advanced to a paper making felt 194 which is supported by a plurality of rolls and the felt is in contact with a shoe press 196. The web generally has a low consistency when transferred to the felt. Transfer to the felt may be assisted by vacuum using, for example, a vacuum roll 198 or a vacuum box or shoe. As the tissue web reaches the shoe press roll it may have a consistency of from about 10% to about 25%, such as from about 20% to about 25% as it enters a nip 200 between a shoe press roll 196 and a transfer roll 202. The transfer roll 202 may be a heated roll if desired. Instead of a shoe press roll, the roll 196 may be a conventional suction pressure roll. If a shoe press is employed, a roll 204 may comprise a vacuum roll effective to remove water from the felt prior to the felt entering the shoe press nip. The vacuum roll 204 may be used to ensure that the web remains in contact with the felts during the direction change.

The tissue web 190 is wet pressed on the felt in the nip 200 with the assistance of the pressure shoe 206. The web is thus compactively de-watered at 200, typically by increasing the consistency by 15 or more percent at this stage of the process. The configuration shown at 200 is generally termed a shoe press. In connection with the present disclosure, a cylinder 202 is operative as a transfer cylinder which operates to convey the tissue web 190 at a high speed such as from about 1000 fpm to about 6000 fpm. The tissue web is conveyed to the creping fabric.

The cylinder 202 has a smooth surface 208 which may be treated with the additive composition of the present disclosure. The additive composition may be applied to the surface of the cylinder by spraying or printing. The tissue web 190 is adhered to the transfer surface 208 of cylinder 202 which is rotating at a relatively high angular velocity as the web continues to advance in the machine direction indicated by the arrow 210. On the cylinder, the tissue web 190 has a generally random apparent distribution of fiber.

The tissue web 190 enters the nip 200 typically at consistencies of from about 10% to about 25% and is de-watered and dried to a consistency from about 25% to about 70% by the time it is transferred to a creping fabric 176.

The creping fabric 176 is supported on a plurality of rolls including a press nip roll 212. A fabric crepe nip 214 is formed between the creping fabric 176 and the transfer cylinder 202.

The creping fabric defines a creping nip over the distance in which the creping fabric 176 is adapted to contact of the roll 202. Within the nip, the creping fabric applies significant pressure to the tissue web against the transfer cylinder. A backing or creping roll 216 may be provided with a soft deformable surface which will increase the length of the creping nip and increase the fabric creping angle between the fabric and the sheet and the point of contact. Alternatively, a shoe press roll may be used as roll 216 to increase effective contact with the web in the high impact fabric creping nip 214 where the tissue web 190 is transferred to the fabric 176 and advanced in the machine direction. By using different equipment at the creping nip, it is possible to adjust the fabric creping angle or the takeaway angle from the creping nip. Thus, it is possible to influence the nature and amount of redistribution of fiber, delamination/debonding which may occur at the fabric creping nip 214 by adjusting the nip parameters. In some embodiments, it may be desirable to restructure the z-direction interfiber characteristics; while in other cases, it may be desirable to influence properties only in the plane of the web. The creping nip parameters can influence the distribution of fiber in the web in a variety of directions, including inducing changes in the z-direction as well as the machine direction and/or cross machine direction. In any case, the transfer from the transfer cylinder to the creping fabric is high impact in that the fabric is traveling slower than the web and a significant velocity change occurs. Typically, the tissue web is fabric creped anywhere from 10% to about 60% and higher (up to about 200% to about 300%) during transfer from the transfer cylinder to the fabric. The creping nip 214 generally extends over a fabric creping nip distance of anywhere from about ⅛ inch to about 2 inches, such as from about ½ inch to about 2 inches. For a creping fabric with 32 cross directional strands per inch, the tissue web 190 will encounter anywhere from about 4 to about 64 weft filaments in the nip.

The nip pressure in the nip 214, that is, the loading between the backing roll 216 and the transfer roll 202 is suitably from about 20 to about 200 pounds per linear inch, such as from about 40 to about 70 pounds per linear inch.

After fabric creping, the tissue web continues to advance along the machine direction where it is wet pressed onto a dryer drum or cylinder 218, such as a Yankee cylinder in a transfer nip 220. Transfer nip 220 occurs at a web consistency from about 25% to about 70%. In accordance with the present disclosure, the additive composition can be applied to the tissue web and/or to the cylinder surface in order to adhere the web to the cylinder. For instance, the additive composition can be sprayed or printed onto the surface of the cylinder 218 and/or can be sprayed or printed onto a surface of the tissue web. When applied to the surface of the cylinder 218 the additive composition not only adheres the web to the surface, but also transfers to the surface of the tissue web as the tissue web is creped from the surface of the cylinder 218.

The web is dried on the Yankee cylinder 218 by high jet velocity impingement air in the hood 224. As the cylinder rotates, the tissue web 190 is creped from the cylinder by a creping blade 226 and wound on a take up roll 228. Creping of the paper from the heated drum or cylinder may be carried out using an undulatoraty creping blade.

When a wet-crepe process is employed, an impingement air dryer, a through-air dryer, or a plurality of can dryers can be used instead of the Yankee dryer as shown in FIG. 7.

As described above, the additive composition of the present disclosure can be applied to the tissue web in FIG. 7 at the transfer roll 202 and/or at the dryer drum 218. Alternatively or in addition, the additive composition can be applied to the tissue web at any location in between the transfer roll 202 and the dryer drum 218. The additive composition can be sprayed or printed onto the tissue web or, alternatively, can be applied to the creping fabric 176 for transfer to the tissue web.

Other processes for producing tissue webs that may be treated in accordance with the present disclosure may be disclosed, for instance, in PCT Publication No. WO 98/55691, U.S. Patent Publication No. 2005/0217814, and U.S. Pat. No. 6,736,935, which are all incorporated herein by reference.

In addition to applying the additive composition during formation of the tissue web, the additive composition may also be used in post-forming processes. For example, in one embodiment, the additive composition may be used during a print-creping process. Specifically, once topically applied to a tissue web, the additive composition has been found well-suited to adhering the tissue web to a creping surface, such as in a print-creping operation.

For example, once a tissue web is formed and dried, in one embodiment, the additive composition may be applied to at least one side of the web and then at least one side of the web may then be creped. In general, the additive composition may be applied to only one side of the web and only one side of the web may be creped, the additive composition may be applied to both sides of the web and only one side of the web is creped, or the additive composition may be applied to each side of the web and each side of the web may be creped.

Figure 8:
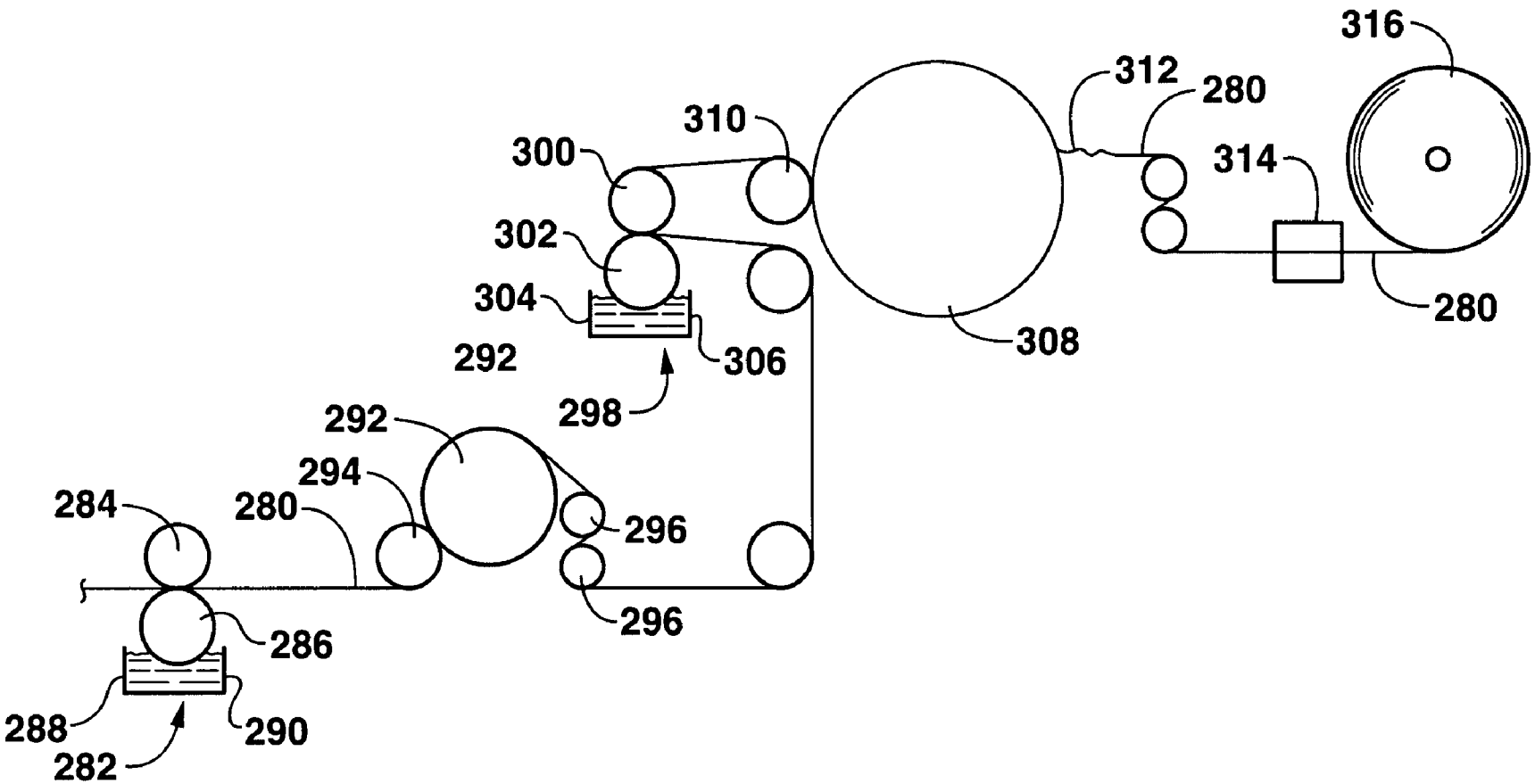
FIG. 8 is a schematic diagram of one embodiment of a process for applying additive compositions to each side of a tissue web and creping one side of the web in accordance with the present disclosure.

Referring to FIG. 8, one embodiment of a system that may be used to apply the additive composition to the tissue web and to crepe one side of the web is illustrated. The embodiment shown in FIG. 8 can be an in-line or off-line process. As shown, tissue web 280 made according to the process illustrated in any of the embodiments above or according to a similar process, is passed through a first additive composition application station generally 282. Station 282 includes a nip formed by a smooth rubber press roll 284 and a patterned rotogravure roll 286. Rotogravure roll 286 is in communication with a reservoir 288 containing a first additive composition 290. Rotogravure roll 286 applies the additive composition 290 to one side of web 280 in a preselected pattern.

Web 280 is then contacted with a heated roll 292 after passing a roll 294. The heated roll 292 can be heated to a temperature, for instance, up to about 200° C. and particularly from about 100° C. to about 150° C. In general, the web can be heated to a temperature sufficient to dry the web and evaporate any water.

It should be understood that besides the heated roll 292 any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll 292, the web 280 can be advanced by pull rolls 296 to a second additive composition application station generally 298. Station 298 includes a transfer roll 300 in contact with a rotogravure roll 302, which is in communication with a reservoir 304 containing a second additive composition 306. Similar to station 282, second additive composition 306 is applied to the opposite side of web 280 in a preselected pattern. Once the second additive composition is applied, web 280 is adhered to a creping roll 308 by a press roll 310. Web 280 is carried on the surface of the creping drum 308 for a distance and then removed therefrom by the action of a creping blade 312. The creping blade 312 performs a controlled pattern creping operation on the second side of the tissue web.

Once creped, tissue web 280, in this embodiment, is pulled through a drying station 314. Drying station 314 can include any form of a heating unit, such as an oven energized by infra-red heat, microwave energy, hot air or the like. Drying station 314 may be necessary in some applications to dry the web and/or cure the additive composition. Depending upon the additive composition selected, however, in other applications drying station 314 may not be needed.

The amount that the tissue web is heated within the drying station 314 can depend upon the particular thermoplastic resins used in the additive composition, the amount of the composition applied to the web, and the type of web used. In some applications, for instance, the tissue web can be heated using a gas stream such as air at a temperature of about 100° C. to about 200° C.

In the embodiment illustrated in FIG. 8, although the additive composition is being applied to each side of the tissue web, only one side of the web undergoes a creping process. It should be understood, however, that in other embodiments both sides of the web may be creped. For instance, the heated roll 292 may be replaced with a creping drum such as 308 shown in FIG. 8.

Creping the tissue web as shown in FIG. 8 increases the softness of the web by breaking apart fiber-to-fiber bonds contained within the tissue web. Applying the additive composition to the outside of the paper web, on the other hand, not only assists in creping the web but also adds dry strength, wet strength, stretchability and tear resistance to the web. Further, the additive composition reduces the release of lint from the tissue web.

In general, the first additive composition and the second additive composition applied to the tissue web as shown in FIG. 8 may contain the same ingredients or may contain different ingredients. Alternatively, the additive compositions may contain the same ingredients in different amounts as desired.

The additive composition is applied to the base web as described above in a preselected pattern. In one embodiment, for instance, the additive composition can be applied to the web in a reticular pattern, such that the pattern is interconnected forming a net-like design on the surface.

In an alternative embodiment, however, the additive composition is applied to the web in a pattern that represents a succession of discrete shapes. Applying the additive composition in discrete shapes, such as dots, provides sufficient strength to the web without covering a substantial portion of the surface area of the web.

According to the present disclosure, the additive composition is applied to each side of the paper web so as to cover from about 15% to about 75% of the surface area of the web. More particularly, in most applications, the additive composition will cover from about 20% to about 60% of the surface area of each side of the web. The total amount of additive composition applied to each side of the web can be in the range of from about 1% to about 30% by weight, based upon the total weight of the web, such as from about 1% to about 20% by weight, such as from about 2% to about 10% by weight.

At the above amounts, the additive composition can penetrate the tissue web after being applied in an amount up to about 30% of the total thickness of the web, depending upon various factors. It has been discovered, however, that most of the additive composition primarily resides on the surface of the web after being applied to the web. For instance, in some embodiments, the additive composition penetrates the web less than 5%, such as less than 3%, such as less than 1% of the thickness of the web.

Figure 9:
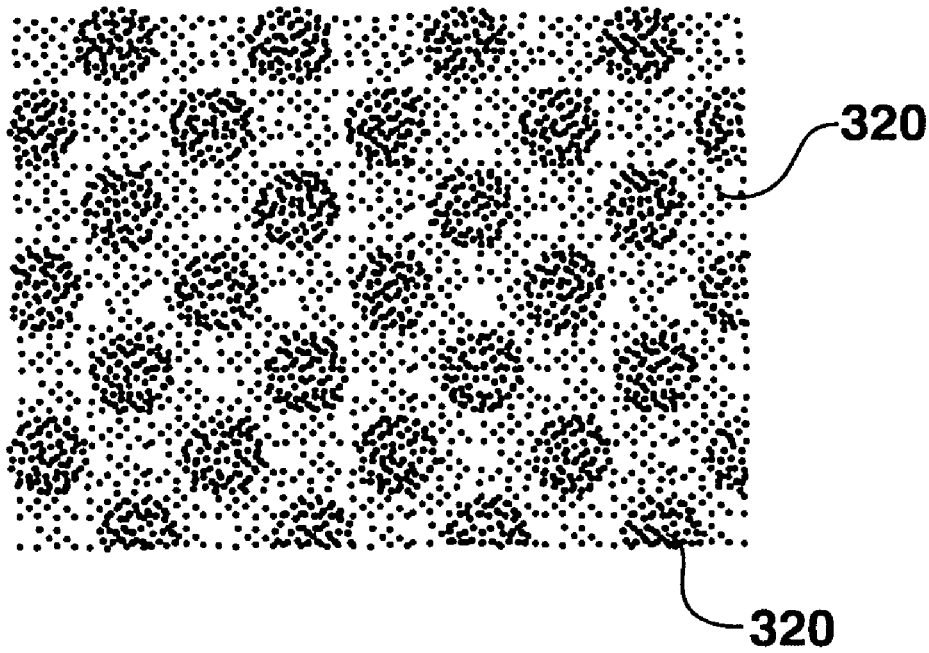
FIG. 9 is a plan view of one embodiment of a pattern that is used to apply additive compositions to tissue webs made in accordance with the present disclosure.

Referring to FIG. 9, one embodiment of a pattern that can be used for applying an additive composition to a paper web in accordance with the present disclosure is shown. As illustrated, the pattern shown in FIG. 9 represents a succession of discrete dots 320. In one embodiment, for instance, the dots can be spaced so that there are approximately from about 25 to about 35 dots per inch in the machine direction or the cross-machine direction. The dots can have a diameter, for example, of from about 0.01 inches to about 0.03 inches. In one particular embodiment, the dots can have a diameter of about 0.02 inches and can be present in the pattern so that approximately 28 dots per inch extend in either the machine direction or the cross-machine direction. In this embodiment, the dots can cover from about 20% to about 30% of the surface area of one side of the paper web and, more particularly, can cover about 25% of the surface area of the web.

Figure 11:
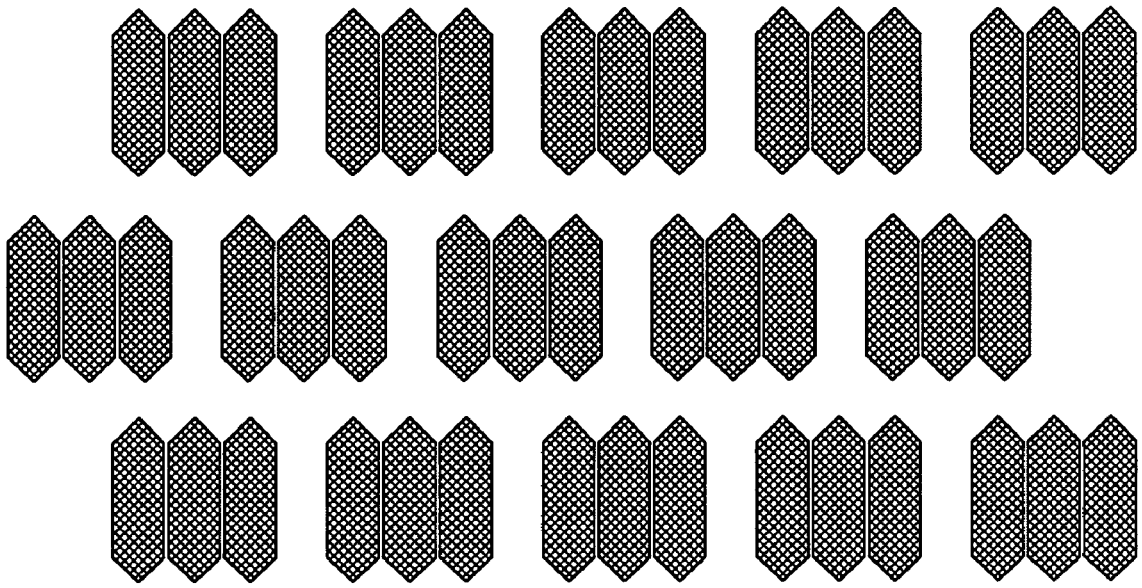
FIG. 11 is a plan view of another alternative embodiment of a pattern that is used to apply additive compositions to tissue webs in accordance with the present disclosure.

Besides dots, various other discrete shapes can also be used. For example, as shown in FIG. 11, a pattern is illustrated in which the pattern is made up of discrete shapes that are each comprised of three elongated hexagons. In one embodiment, the hexagons can be about 0.02 inches long and can have a width of about 0.006 inches. Approximately 35 to 40 hexagons per inch can be spaced in the machine direction and the cross-machine direction. When using hexagons as shown in FIG. 11, the pattern can cover from about 40% to about 60% of the surface area of one side of the web, and more particularly can cover about 50% of the surface area of the web.

Figure 10:
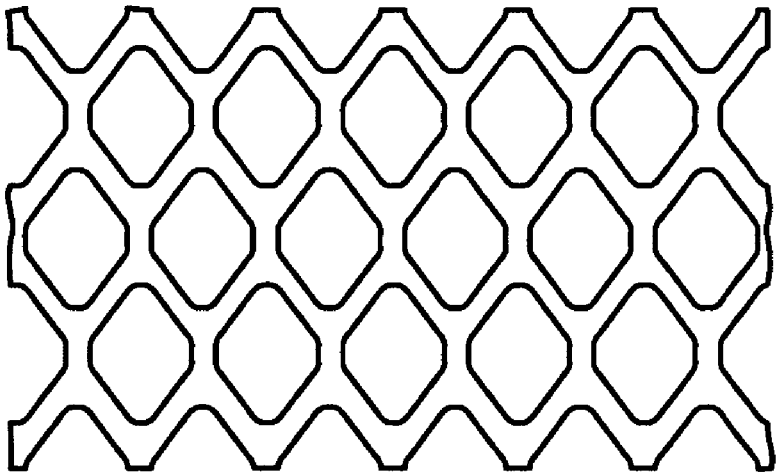
FIG. 10 is another embodiment of a pattern that is used to apply additive compositions to tissue webs in accordance with the present disclosure.

Referring to FIG. 10, another embodiment of a pattern for applying an additive composition to a paper web is shown. In this embodiment, the pattern is a reticulated grid. More specifically, the reticulated pattern is in the shape of diamonds. When used, a reticulated pattern may provide more strength to the web in comparison to patterns that are made up on a succession of discrete shapes.

The process that is used to apply the additive composition to the tissue web in accordance with the present disclosure can vary. For example, various printing methods can be used to print the additive composition onto the base sheet depending upon the particular application. Such printing methods can include direct gravure printing using two separate gravures for each side, offset gravure printing using duplex printing (both sides printed simultaneously) or station-to-station printing (consecutive printing of each side in one pass). In another embodiment, a combination of offset and direct gravure printing can be used. In still another embodiment, flexographic printing using either duplex or station-to-station printing can also be utilized to apply the additive composition.

According to the process of the current disclosure, numerous and different tissue products can be formed. For instance, the tissue products may be single-ply wiper products. The products can be, for instance, facial tissues, bath tissues, paper towels, napkins, industrial wipers, and the like. As stated above, the basis weight can range anywhere from about 10 gsm to about 110 gsm.

Tissue products made according to the above processes can have relatively good bulk characteristics. For example, the tissue webs can have a bulk of greater than about 8 cc/g, such as greater than about 10 cc/g, such as greater than about 11 cc/g.

In one embodiment, tissue webs made according to the present disclosure can be incorporated into multiple-ply products. For instance, in one embodiment, a tissue web made according to the present disclosure can be attached to one or more other tissue webs for forming a wiping product having desired characteristics. The other webs laminated to the tissue web of the present disclosure can be, for instance, a wet-creped web, a calendered web, an embossed web, a through-air dried web, a creped through-air dried web, an uncreped through-air dried web, an airlaid web, a hydroentangled web, a coform web, and the like.

In one embodiment, when incorporating a tissue web made according to the present disclosure into a multiple-ply product, it may be desirable to only apply the additive composition to one side of the tissue web and to thereafter crepe the treated side of the web. The creped side of the web is then used to form an exterior surface of a multiple ply product. The untreated and uncreped side of the web, on the other hand, is attached by any suitable means to one or more plies.

Figure 12:
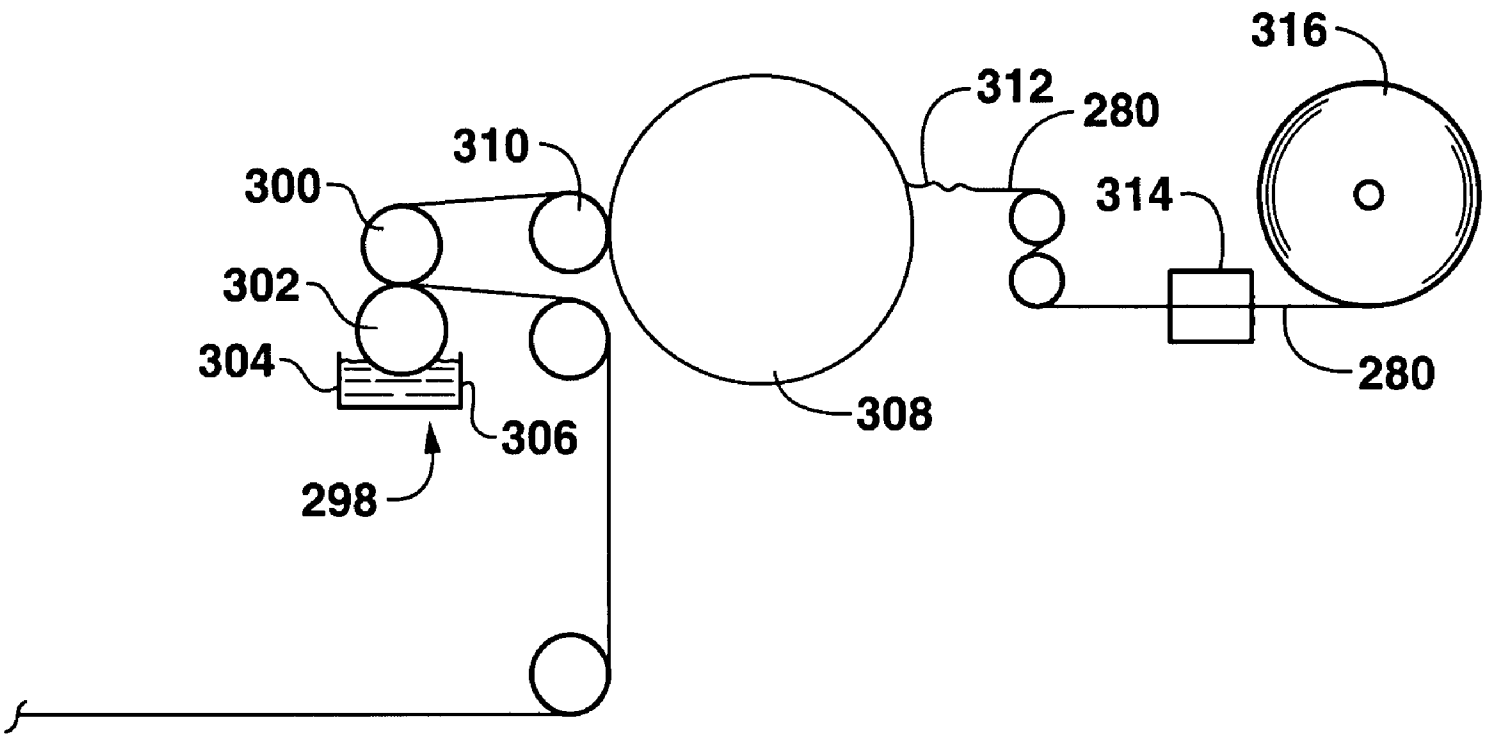
FIG. 12 is a schematic diagram of an alternative embodiment of a process for applying an additive composition to one side of the tissue web and creping one side of the web in accordance with the present disclosure.

For example, referring to FIG. 12, one embodiment of a process for applying the additive composition to only one side of a tissue web in accordance with the present disclosure is shown. The process illustrated in FIG. 12 is similar to the process shown in FIG. 8. In this regard, like reference numerals have been used to indicate similar elements.

As shown, a web 280 is advanced to an additive composition application station generally 298. Station 298 includes a transfer roll 300 in contact with a rotogravure roll 302, which is in communication with a reservoir 304 containing an additive composition 306. At station 298, the additive composition 306 is applied to one side of the web 280 in a preselected pattern.

Once the additive composition is applied, web 280 is adhered to a creping roll 308 by a press roll 310. Web 280 is carried on the surface of the creping drum 308 for a distance and then removed therefrom by the action of a creping blade 312. The creping blade 312 performs a controlled pattern creping operation on the treated side of the web.

From the creping drum 308, the tissue web 280 is fed through a drying station 314 which dries and/or cures the additive composition 306. The web 280 is then wound into a roll 316 for use in forming multiple ply products.

When only treating one side of the tissue web 280 with an additive composition, in one embodiment, it may be desirable to apply the additive composition according to a pattern that covers greater than about 40% of the surface area of one side of the web. For instance, the pattern may cover from about 40% to about 60% of the surface area of one side of the web. In one particular example, for instance, the additive composition can be applied according to the pattern shown in FIG. 11.

In one specific embodiment of the present disclosure, a two-ply product is formed from a first paper web and a second paper web in which both paper webs are generally made according to the process shown in FIG. 12. For instance, a first paper web made according to the present disclosure can be attached to a second paper web made according to the present disclosure in a manner such that the creped sides of the webs form the exterior surfaces of the resulting product. The creped surfaces are generally softer and smoother creating a two-ply product having improved overall characteristics.

The manner in which the first paper web is laminated to the second paper web may vary depending upon the particular application and desired characteristics. In some applications, the alpha-olefin interpolymer of the present disclosure may serve as the ply-bonding agent. In other applications, a binder material, such as an adhesive or binder fibers, is applied to one or both webs to join the webs together. The adhesive can be, for instance, a latex adhesive, a starch-based adhesive, an acetate such as an ethylene-vinyl acetate adhesive, a polyvinyl alcohol adhesive, and the like. It should be understood, however, that other binder materials, such as thermoplastic films and fibers can also be used to join the webs. The binder material may be spread evenly over the surfaces of the web in order to securely attach the webs together or may be applied at selected locations.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for producing a tissue product comprising:

forming a tissue web from an aqueous suspension of fibers;

conveying the tissue web through a first through-air dryer and a second through-air dryer that substantially dries the tissue web;

applying an additive composition to at least one side of the tissue web during the process, the additive composition comprising an aqueous dispersion containing a non-fibrous alpha-olefin polymer, the additive composition adhering the tissue web to a creping surface and wherein the tissue product has a bulk of greater than about 3 cc/g after the additive composition has been applied; and creping the tissue web from the creping surface.

2. A process as defined in claim 1, wherein the first through-air dryer and the second through-air dryer are arranged in series.

3. A process as defined in claim 2, wherein the alpha-olefin polymer comprises an alpha-olefin interpolymer of ethylene or propylene and at least one comonomer, each comonomer being limited solely to compounds represented by the formula $H_2C{=}CHR$, wherein R is a $C_1$ to $C_{20}$ linear, or branched alkyl group.

4. A process as defined in claim 2, wherein the additive composition comprises a mixture of the olefin polymer and an ethylene-carboxylic acid copolymer.

5. A process as defined in claim 2, wherein the additive composition is applied to the tissue web in between the first through-air dryer and the second through-air dryer.

6. A process as defined in claim 5, wherein the additive composition is applied to the tissue web while the tissue web has a consistency of at least about 40%.

7. A process as defined in claim 2, wherein the additive composition is applied to the tissue web after the second through-air dryer.

8. A process for producing a tissue product comprising:

forming a tissue web from an aqueous suspension of fibers;

conveying the web through a de-watering device for de-watering the tissue web, the de-watering device comprising a press belt placed adjacent to a vacuum roll and wherein the tissue web is dewatered by conveying the web on a fabric between the press belt and the vacuum roll, or the de-watering device comprising an imprinting conveyor placed adjacent to a compression nip and wherein the web is dewatered by being conveyed in between the imprinting conveyor and the compression nip;

conveying the tissue web over at least a first drying device for drying the tissue web;

applying an additive composition to at least one side of the tissue web during the process, the additive composition comprising an aqueous dispersion containing a non-fibrous alpha-olefin polymer, the additive composition adhering the tissue web to a surface of the drying device and wherein the tissue product has a bulk of greater than about 3 cc/g after the additive composition has been applied; and creping the tissue web from the surface of the drying device.

9. A process as defined in claim 8, wherein the alpha-olefin polymer comprises an alpha-olefin interpolymer of ethylene or propylene and at least one comonomer, each comonomer being limited solely to compounds represented by the formula $H_2C{=}CHR$, wherein R is a $C_1$ to $C_{20}$ linear, or branched alkyl group.

10. A process as defined in claim 8, wherein the additive composition comprises a mixture of the olefin polymer and an ethylene-carboxylic acid copolymer.

11. A process as defined in claim 8, wherein the web is conveyed over a second drying device before being conveyed over the first drying device, the second drying device comprising a through-air dryer, the first drying device comprising a heated drying cylinder.

12. A process as defined in claim 8, wherein the de-watering device comprises a first de-watering felt positioned adjacent to a first side of the imprinting conveyor, the de-watering device further comprising a second de-watering felt positioned against a second and opposite side of the imprinting conveyor, a compression nip being formed between the first de-watering felt and the first side of the imprinting conveyor, the tissue web being fed into the compression nip.

13. A process as defined in claim 11, wherein the additive composition is applied in between the first drying device and the second drying device.

14. A process as defined in claim 11, wherein the additive composition is applied between the de-watering device and the first drying device.

15. A process for producing a tissue product comprising:

forming a tissue web from an aqueous suspension of fibers on a forming section, the tissue web then being conveyed through a felt section, a press section, and a creping section;

conveying the tissue web into a nip formed between a shoe press roll or a suction roll of the felt section and a transfer roll of the press section, the tissue web being dewatered such that the consistency of the web is increased by 15% or more;

conveying the tissue web through a drying device for drying the web;

applying an additive composition to at least one side of the tissue web, the addictive composition adhering the tissue web to a creping surface, the additive composition comprising an aqueous dispersion containing a non-fibrous alpha-olefin polymer, and wherein the tissue product has a bulk of greater than about 3 cc/g after the additive composition has been applied; and creping the tissue roll from the creping surface.

16. A process as defined in claim 15, wherein the alpha-olefin polymer comprises an alpha-olefin interpolymer of ethylene or propylene and at least one comonomer, each comonomer being limited solely to compounds represented by the formula $H_2C{=}CHR$, wherein R is a $C_1$ to $C_{20}$ linear, or branched alkyl group.

17. A process as defined in claim 15, wherein the additive composition comprises a mixture of the olefin polymer and an ethylene-carboxylic acid copolymer.

18. A process as defined in claim 15, wherein the drying device comprises a rotating heated cylinder that defines the creping surface, the tissue web being creped from the surface of the drying device.

19. A process as defined in claim 15, wherein the transfer roll is heated.

20. A process as defined in claim 15, wherein the additive composition is applied to the tissue web while the tissue web is being conveyed on a fabric and prior to the dryer device.

21. A process as defined in claim 18, wherein the additive composition is applied to a surface of the heated cylinder, the additive composition transferring to the tissue web as the web is creped from the surface of the cylinder.

22. A process as defined in claim 1, wherein the alpha-olefin polymer has a melting point of less than 120° C.

23. A process as defined in claim 8, wherein the alpha-olefin polymer has a melting point of less than 120° C.

24. A process as defined in claim 15, wherein the alpha-olefin polymer has a melting point of less than 120° C.

* * * * *